US007217447B2

(12) United States Patent
Takashima et al.

(10) Patent No.: US 7,217,447 B2
(45) Date of Patent: May 15, 2007

(54) INK-JET RECORDING SHEET

(75) Inventors: Masanobu Takashima, Shizuoka-ken (JP); Kozo Nagata, Shizuoka-ken (JP); Hisao Yamada, Shizuoka-ken (JP); Kazuyuki Koike, Shizuoka-ken (JP); Kousaku Yoshimura, Shizuoka-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/277,088

(22) Filed: Oct. 22, 2002

(65) Prior Publication Data

US 2004/0202837 A1 Oct. 14, 2004

(30) Foreign Application Priority Data

Jan. 22, 2002 (JP) ..... 2002-013005

(51) Int. Cl.
*B41M 5/00* (2006.01)

(52) U.S. Cl. ..... 428/32.15; 428/32.25; 428/32.26; 428/32.3

(58) Field of Classification Search ..... 428/32.15, 428/32.26, 32.29, 32.3, 32.34
See application file for complete search history.

(56) References Cited

U.S. PATENT DOCUMENTS

| | | | | |
|---|---|---|---|---|
| 5,141,797 | A * | 8/1992 | Wheeler | 428/195.1 |
| 5,567,507 | A * | 10/1996 | Paff et al. | 428/32.13 |
| 5,709,737 | A * | 1/1998 | Malhotra et al. | 106/31.43 |
| 6,102,997 | A | 8/2000 | Helling et al. | |
| 6,495,242 | B1 * | 12/2002 | Tsuchiya et al. | 428/32.24 |
| 6,495,243 | B1 * | 12/2002 | Malhotra | 428/32.24 |

FOREIGN PATENT DOCUMENTS

| | | | |
|---|---|---|---|
| EP | 0615855 | A1 * | 9/1994 |
| EP | 1 138 509 | A2 | 10/2001 |
| JP | 6-502358 | A | 3/1994 |
| JP | 7-1832 | | 1/1995 |
| JP | 7-257018 | | 10/1995 |
| JP | 7-257019 | | 10/1995 |
| JP | 8-238839 | | 9/1996 |
| JP | 9-1922 | A | 1/1997 |
| JP | 9-314991 | A | 12/1997 |
| JP | 2001158164 | * | 6/2001 |
| JP | 2001-341418 | A | 12/2001 |
| JP | 2002-283706 | A | 10/2002 |
| JP | 2002-292998 | A | 10/2002 |
| WO | WO 92/07722 | A1 | 5/1992 |

* cited by examiner

*Primary Examiner*—Pamela R. Schwartz
(74) *Attorney, Agent, or Firm*—Sughrue Mion, PLLC

(57) ABSTRACT

An ink-jet recording sheet including a color material receiving layer on a substrate. The color material receiving layer contains a compound represented by the following general formula (I), General formula (I)

In the general formula (I), $R^1$ and $R^2$ each independently represent a hydrogen atom, an aliphatic group, an aromatic group, a heterocyclic group, —$COR^3$, —$COOR^4$, —$SO_2$—$R^5$, or —$N(R^6)R^7$. $R^3$ and $R^5$ each independently represent a hydrogen atom, an aliphatic group, an aromatic group, a heterocyclic group, or —$N(R^8)R^9$. $R^4$ represents a hydrogen atom, an aliphatic group, an aromatic group, or a heterocyclic group. $R^6$ to $R^9$ each independently represent a hydrogen atom, an aliphatic group, an aromatic group, an acyl group, an alkoxy carbony group, an aryloxy carbonyl group, a carbamoyl group, an alkyl sulfonyl group, an aryl sulfonyl group, or a sulfamoyl group. $R^1$ and $R^2$ may link with each other so as to form a ring. $R^{10}$ to $R^{14}$ each independently represent a hydrogen atom, an aliphatic group, an aromatic group, a heterocyclic group, —$COR^{31}$, —$COOR^{32}$, or —$N(R^{33})R^{34}$. $R^{31}$ represents a hydrogen atom, an aliphatic group, an aromatic group, a heterocyclic group or —$N(R^8)R^9$. $R^{32}$ represents a hydrogen atom, an aliphatic group, an aromatic group, or a heterocyclic group. $R^{33}$ and $R^{34}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group.

21 Claims, No Drawings

INK-JET RECORDING SHEET

BACKGROUND OF THE INVENTION

1. Field of the Invention

The present invention relates to a material to be recorded supplied for ink-jet recording, using a liquid ink such as a water based ink (one using a dye or a pigment as the coloring material) and an oil based ink, a solid ink in a solid state at an ordinary temperature, supplied for printing after melting and liquefying, or the like. More specifically, it relates to an ink-jet recording sheet having an excellent ink receptivity, with a light resistance and an ozone resistance of a recorded image improved.

2. Description of the Related Art

Recently, with the rapid development of the information technology (IT) industry, various information processing systems have been developed, and recording methods and apparatus suitable for the recording systems have been developed as well so as to be put into practical use.

Among these recording methods, the ink-jet recording method is used widely not only in the offices but also at home for the capability of recording on various kinds of recording materials, relative inexpensiveness of the hardware (apparatus), compactness, the excellent quietness, or the like.

Moreover, with the recent trend toward the high resolution in the ink-jet printer, the so-called photography-like high image quality recorded material can be obtained. Furthermore, according to the development of the hardware (apparatus), various kinds of recording sheets for ink-jet recording have been developed.

As the characteristics required for the above-mentioned recording sheets for ink-jet recording, in general, (1) quick drying property (large absorbing speed of the ink), (2) appropriate and even ink dot size (absence of blurring), (3) good granule property, (4) high dot roundness, (5) high color density, (6) high chroma (absence of darkness), (7) good water resistance, light resistance and ozone resistance in the printing part, (8) high whiteness in the recording sheet, (9) good recording sheet storage property (absence of yellowish coloring by the long term storage), (10) good size stability without deformation (sufficiently small curling), (11) good hardware running property, or the like can be presented.

Furthermore, as to the application of the photo glossy paper used for obtaining the so-called photography-like high image quality recorded material, in addition to the above-mentioned characteristics, the glossiness, the surface smoothness, the printing paper-like feeling similar to the silver salt photography, or the like are required as well.

For improvement of the above-mentioned various characteristics, recently, an ink-jet recording sheet having a porous structure in a color material accepting layer has been developed. Since the ink-jet recording sheet has the excellent ink receptivity (quick drying property) and a high glossiness.

For example, Japanese Patent Application Laid-Open (JP-A) Nos. 10-119423 and 10-217601, or the like propose an ink-jet recording sheet comprising a color material accepting layer containing fine inorganic pigment particles and a water soluble resin, and a high void ratio provided on a substrate.

According to these recording sheets, in particular, an ink-jet recording sheet provided with a color material accepting layer using a silica as the inorganic pigment fine particles of a porous structure provides the excellent ink absorbing property, a high in acceptability capable of forming a high resolution image and a high glossiness according to the configuration.

However, a minute amount gas in the air, in particular, the ozone is the cause of fading with age of a recorded image. Since the above-mentioned recording material comprising a color material accepting layer with the porous structure has a large number of voids, the recorded image can easily be faded by the ozone gas in the air. Therefore, for a recording material having a color material accepting layer of the above-mentioned porous structure, the resistance to the ozone in the air (ozone resistance) is an extremely important characteristic.

In order to prevent the above-mentioned fading by the ozone, JP-A No. 2001-260519 proposes an ink-jet recording material containing a sulfinic acid compound, a thiosulfonic acid compound, and a thiosulfinic acid compound. Moreover, the EP 1,138,509 proposes an ink-jet recording material containing a thioether compound having a hydrophilic group. Although these are effective in terms of the ozone resistance, the effect does not last long, and thus a problem is involved in that a sufficient ozone resistance cannot be provided.

Moreover, JP-A No. 7-314882 discloses a recording sheet having a porous ink accepting layer containing at least one compound selected from the group consisting of a dithiocarbamate, a thiuram salt, ester thiocyanates, a thiocyanate, and a hindered amine compound. As specific examples of the above-mentioned hindered amine compound, those having a structure with all the hydrogen on the carbons at the second position and the sixth position of a piperidine substituted by a methyl group are presented. Although the recording sheet has a fading preventing effect for about 30 days in a room can be provided by containing at least one of the above-mentioned compounds a problem is involved in that a sufficiently long term ozone resistance cannot be provided.

SUMMARY OF THE INVENTION

As mentioned above, in the present state, an ink-jet recording sheet comprising a color material accepting layer with a good ink absorbing property so as to form a high resolution image as well as a sufficiently long term ozone resistance while having the ink receptivity with the excellent light resistance, water resistance, blurring by aging, and glossiness of the formed image has not been provided so far.

The purpose of the present invention in particular is to provide an ink-jet recording sheet with the ozone resistance improved.

In order to solve the above-mentioned problems, the invention is as described below.

A first aspect of the invention provides an ink-jet recording sheet comprising a color material accepting layer disposed on a substrate, the color material accepting layer containing a compound represented by the following general formula (I):

General formula (I)

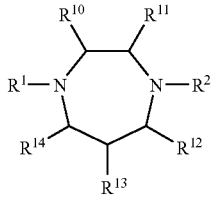

wherein, in the general formula (I), $R^1$ and $R^2$ each independently represent a hydrogen atom, an aliphatic group, an aromatic group, a heterocyclic group, —$COR^3$, —$COOR^4$, —$SO_2$—$R^5$, or —$N(R^6)R^7$; $R^3$ and $R^5$ each independently represent a hydrogen atom, an aliphatic group, an aromatic group, a heterocyclic group, or —$N(R^8)R^9$; $R^4$ represents a hydrogen atom, an aliphatic group, an aromatic group, or a heterocyclic group; $R^6$ through $R^9$ each independently represent a hydrogen atom, an aliphatic group, an aromatic group, an acyl group, an alkoxy carbony group, an aryloxy carbonyl group, a carbamoyl group, an alkyl sulfonyl group, an aryl sulfonyl group, or a sulfamoyl group; $R^1$ and $R^2$ may link with each other so as to form a ring; $R^{10}$ to $R^{14}$ each independently represent a hydrogen atom, an aliphatic group, an aromatic group, a heterocyclic group, —$COR^{31}$, —$COOR^{32}$, or —$N(R^{33})R^{34}$; $R^{31}$ represents a hydrogen atom, an aliphatic group, an aromatic group, a heterocyclic group or —$N(R^8)R^9$; $R^{32}$ represents a hydrogen atom, an aliphatic group, an aromatic group, or a heterocyclic group; and $R^{33}$ and $R^{34}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group.

A second aspect of the invention provides an ink-jet recording sheet comprising a color material accepting layer disposed on a substrate, the color material accepting layer containing a compound represented by the following general formula (II):

General formula (II)

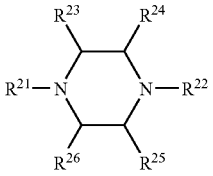

wherein, in the general formula (II), $R^{21}$ and $R^{22}$ each independently represent a hydrogen atom, an aliphatic group, an aromatic group, ah eterocyclic group, —$COR^{53}$, —$COOR^{54}$, —$SO_2$—$R^{55}$, or —$N(R^{56})R^{57}$; $R^{53}$ and $R^{55}$ each independently represent a hydrogen atom, an aliphatic group, an aromatic group, a heterocyclic group, or —$N(R^{58})R^{59}$; $R^{54}$ represents a hydrogen atom, an aliphatic group, an aromatic group, or a heterocyclic group; $R^{56}$ through $R^{59}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; $R^{21}$ and $R^{22}$ may link with each other so as to form a ring; $R^{23}$ represents an aliphatic group, an aromatic group, a heterocyclic group, —$COR^{71}$, —$COOR^{72}$, or —$N(R^{73})R^{74}$; $R^{24}$ through $R^{26}$ each independently represent a hydrogen atom, an aliphatic group, an aromatic group, a heterocyclic group, —$COR^{71}$, —$COOR^{72}$, or —$N(R^{73})R^{74}$; $R^{71}$ represents a hydrogen atom, an aliphatic group, an aromatic group, a heterocyclic group or —$N(R^{58})R^{59}$; $R^{72}$ represents a hydrogen atom, an aliphatic group, an aromatic group, or a heterocyclic group; and $R^{73}$ and $R^{74}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group.

A third aspect of the invention provides an ink-jet recording sheet comprising a color material accepting layer disposed on a substrate, the color material accepting layer containing a compound represented by the following general formula (III), fine particles and a water soluble resin, and the solid component content of the fine particles in the color material accepting layer being more than 60% by mass:

General formula (III)

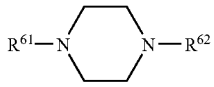

wherein, in the general formula (III), $R^{61}$ and $R^{62}$ each independently represent a hydrogen atom, an aliphatic group, an aromatic group, a heterocyclic group, —$COR^{63}$, —$COOR^{64}$, —$SO_2$—$R^{65}$, or —$N(R^{66})R^{67}$; $R^{63}$ and $R^{65}$ each independently represent a hydrogen atom, an aliphatic group, an aromatic group, a heterocyclic group, or —$N(R^{68})R^{69}$; $R^{64}$ represents a hydrogen atom, an aliphatic group, an aromatic group, or a heterocyclic group; $R^{66}$ through $R^{69}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; and $R^{61}$ and $R^{62}$ may link with each other so as to form a ring.

A fourth aspect of the invention provides an ink-jet recording sheet comprising a color material accepting layer disposed on a substrate, the color material accepting layer containing a compound represented by the following general formula (IV), fine particles and a water soluble resin, and a solid component content of the fine particles in the color material accepting layer being more than 60% by mass:

General formula (IV)

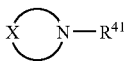

wherein, in the general formula (IV), $R^{41}$ represents a hydrogen atom, an aliphatic group, an aromatic group, a heterocyclic group, —$COR^{43}$, —$COOR^{44}$, —$SO_2$—$R^{45}$, or —$N(R^{46})R^{47}$; $R^{43}$ and $R^{45}$ each independently represent a hydrogen atom, an aliphatic group, an aromatic group, a heterocyclic group, or —$N(R^{48})R^{49}$. $R^{44}$ represents a hydrogen atom, an aliphatic group, an aromatic group, or a heterocyclic group; $R^{46}$ through $R^{49}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; X represents an atom group necessary for forming a 5- to 7-membered ring of a saturated hydrocarbon, which may include an oxygen atom, a sulfur atom, SO or $SO_2$; and $R^{41}$ and the atom group represented by X may link with each other so as to form a ring.

A fifth aspect of the invention provides the ink-jet recording sheet, the color material accepting layer containing at least one compound represented by the above-mentioned general formulae (I) and (II), fine particles and a water soluble resin.

A sixth aspect of the invention provides the ink-jet recording sheet, wherein the above-mentioned fine particles comprise silica fine particles having an average primary particle size of 20 nm or less, alumina fine particles having an average primary particle size of 20 nm or less, or a quasi boehmite having an average pore radius of 2 to 15 nm.

A seventh aspect of the invention provides the ink-jet recording sheet, wherein the above-mentioned water soluble resin comprises a polyvinyl alcohol or a derivative thereof.

An eighth aspect of the invention provides the ink-jet recording sheet, wherein the color material accepting layer further contains a cross-linking agent capable of cross-linking the water soluble resin.

A ninth aspect of the invention provides the ink-jet recording sheet, wherein the above-mentioned cross-linking agent comprises a boron compound.

A tenth aspect of the invention provides the ink-jet recording sheet, wherein the above-mentioned color material accepting layer further contains a mordanting agent.

An eleventh aspect of the invention provides the ink-jet recording sheet, wherein the above-mentioned mordanting agent contains a poly amine having a mass average molecular weight of 300,000 or less or a derivative thereof as an organic mordanting agent, and contains at least one selected from the group consisting of an aluminum containing compound, a zirconium containing compound, a titanium containing compound, a compound of a metal of the third group of the periodic table of elements as an inorganic mordanting agent.

A twelfth aspect of the invention provides the ink-jet recording sheet, wherein the above-mentioned color material accepting layer further contains at least one kind of acidic compound.

A thirteenth aspect of the invention provides the ink-jet recording sheet, wherein the above-mentioned color material accepting layer is obtained by coating a first coating solution containing at least fine particles and a water soluble resin on a surface of the substrate, and applying a second coating solution containing at least a mordanting agent (1) simultaneously with coating of the first coating solution, (2) during drying of a coating layer formed by coating of the first coating solution and before the coating layer displays a decreasing rate of drying, or (3) after drying of the first coating solution and formation of a coating film; and at least one compound represented by the above-mentioned general formulae (I) to (IV) is contained in at least one of the above-mentioned first coating solution and second coating solution.

DESCRIPTION OF THE PREFERRED EMBODIMENTS

It is characteristic of an ink-jet recording sheet of the invention that a color material accepting layer provided on a substrate contains an alicyclic amine compound having a specific structure. Since the specific amine compound is contained, the ozone resistance of the ink-jet recording sheet can remarkably improved as well as the light resistance (in particular, that of the magenta color development) can be improved as well. Moreover, in order to provide both the ink absorbing property (quick drying property) and the glossiness, it is preferable that the above-mentioned color material accepting layer has a porous structure.

As examples of an ink-jet recording sheet containing a certain kind of an alicyclic amine, JP-A Nos. 7-1832, 7-257018, 8-238839, or the like are known. However, according thereto, it is added as an improving agent of the water peeling characteristic, the curling characteristic, and the optical density for an inkjet recording sheet, and there is no description of improvement of the ozone resistance. Furthermore, these are used for a swelling type ink-jet recording sheet, and thus sufficient glossiness and ink absorbing speed are not obtained.

(Compound Represented by the General Formula (I))

According to the ink-jet recording sheet according to the first aspect of the invention, the color material accepting layer provided on the substrate contains a compound represented by the following general formula (I):

General formula (I)

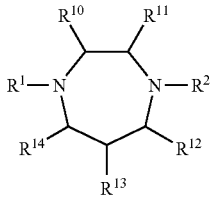

wherein, in the general formula (I), $R^1$ and $R^2$ each independently represent a hydrogen atom, an aliphatic group, an aromatic group, a heterocyclic group, —$COR^3$, —$COOR^4$, —$SO_2$—$R^5$, or —$N(R^6)R^7$; $R^3$ and $R^5$ each independently represent a hydrogen atom, an aliphatic group, an aromatic group, a heterocyclic group, or —$N(R^8)R^9$; $R^4$ represents a hydrogen atom, an aliphatic group, an aromatic group, or a heterocyclic group; $R^6$ through $R^9$ each independently represent a hydrogen atom, an aliphatic group, an aromatic group, an acyl group, an alkoxy carbony group, an aryloxy carbonyl group, a carbamoyl group, an alkyl sulfonyl group, an aryl sulfonyl group, or a sulfamoyl group; $R^1$ and $R^2$ may link with each other so as to form a ring; $R^{10}$ to $R^{14}$ each independently represent a hydrogen atom, an aliphatic group, an aromatic group, a heterocyclic group, —$COR^{31}$, —$COOR^{32}$, or —$N(R^{33})R^{34}$; $R^{31}$ represents a hydrogen atom, an aliphatic group, an aromatic group, a heterocyclic group or —$N(R^8)R^9$; $R^{32}$ represents a hydrogen atom, an aliphatic group, an aromatic group, or a heterocyclic group; $R^{33}$ and $R^{34}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group.

In the case $R^1$ and $R^2$, $R^3$ and $R^5$, $R^4$, $R^6$ to $R^9$, $R^{10}$ through $R^{14}$, $R^{31}$ and $R^{32}$, $R^{33}$ and $R^{34}$ represent an aliphatic group, as the aliphatic group, for example, an alkyl group, an alkenyl group, an alkynyl group, an aralkyl group, or the like can be presented. These groups may further include a substituent. Among these examples, an alkyl group, a substituted alkyl group, an alkenyl group, a substituted alkenyl group, an aralkyl group and a substituted aralkyl group are preferable. In particular, an alkyl group and a substituted alkyl group are preferable.

Moreover, the above-mentioned aliphatic groups may be a chain-like aliphatic group or a cyclic aliphatic group. A chain-like aliphatic group may further include a branch.

As the above-mentioned alkyl group, strait chain-like, branched and cyclic alkyl groups can be presented. The number of carbon atoms of the alkyl groups is preferably 1 to 30, and more preferably 1 to 20. The number of carbon atoms in the alkyl part of the substituted alkyl groups is preferably in the above-mentioned range.

As specific examples of the above-mentioned alkyl groups, a methyl group, an ethyl group, a propyl group, a butyl group, a pentyl group, a hexyl group, an octyl group, a 2-ethyl hexyl group, a t-octyl group, a decyl group, a dodecyl group, an octadecyl group, a cyclohexyl group, a cyclopentyl group, a neopenthyl group, an isopropyl group, an isobutyl group, or the like can be presented.

As the above-mentioned substituent of the substituted alkyl groups, a carboxyl group, a sulfo group, a cyano group, a halogen atom (such as a fluorine atom, a chlorine atom, and a bromine atom), a hydroxyl group, an alkoxy carbonyl group having 30 or less carbon atoms (such as a methoxy carbonyl group, an ethoxy carbonyl group, and a benzyloxy carbonyl group), an aryloxy carbonyl group having 30 or less carbon atoms (such as a phenoxy carbonyl group), an alkyl sulfonyl amino carbonyl group having 30 or less carbon atoms (such as a methyl sulfonyl amino carbonyl group, and an octyl sulfonyl amino carbonyl group), an aryl sulfonyl amino carbonyl group (such as a toluene sulfonyl amino carbonyl group), an acyl amino sulfonyl group having 30 or less carbon atoms (such as a benzoyl amino sulfonyl group, an acetyl amino sulfonyl group, and a pivaloyl amino sulfonyl group), an alkoxy group having 30 or less carbon atoms (such as a methoxy group, an ethoxy group, a benzyloxy group, a phenoxy ethoxy group, and a phenethyl group), an aryl thio group having 30 or less carbon atoms, an alkyl thio group (such as a phenyl thio group, a methyl thio group, an ethyl thio group, and a dodecyl thio group), an aryloxy group having 30 or less carbon atoms (such as a phenoxy group, a p-tolyloxy group, a 1-naphthoxy group, and a 2-naphthoxy group), a nitro group, an alkyl group having 30 or less carbon atoms, an alkoxy carbonyloxy group (such as a methoxy carbonyloxy group, a stearyloxy carbonyloxy group, a phenoxy ethoxy carbonyloxy group), an aryloxy carbonyloxy group (such as a phenoxy carbonyloxy group, a chlorophenoxy carbonyloxy group);

an acyloxy group having 30 or less carbon atoms (such as an acetyloxy group, and a propionyloxy group), an acyl group having 30 or less carbon atoms (such as an acetyl group, a propionyl group, and a benzoyl group), a carbamoyl group (such as a carbamoyl group, an N,N-dimethyl carbamoyl group, a morpholino sulfonyl group, and a piperidine sulfonyl group, or the like), an alkyl sulfonyl group having 30 or less carbon atoms (such as a methyl sulfonyl group, a tolufluoro methyl sulfonyl group, an ethyl sulfonyl group, a butyl sulfonyl group, and a dodecyl sulfonyl group), an aryl sulfonyl group (such as a benzene sulfonyl group, a toluene sulfonyl group, a naphthalene sulfonyl group, a pyridine sulfonyl group, and a quinoline sulfonyl group), an aryl group having 30 or less carbon atoms (such as a phenyl group, a dichloro phenyl group, a toluyl group, a methoxy phenyl group, a diethyl amino phenyl group, an acetyl amino phenyl group, a methoxy carbonyl phenyl group, a hydroxyl phenyl group, a t-octyl phenyl group, and a naphthyl group), a substituted amino group (such as an amino group, an alkyl amino group, a dialkyl amino group, an aryl amino group, a diaryl amino group, and an acyl amino group), a substituted phosphono group (such as a phosphono group, a diethyl phosphono group, and a diphenyl phosphono group), a heterocyclic group (such as a pyridyl group, a quinolyl group, a furil group, a thienyl group, a tetrahydro furfuryl group, a pyrazolyl group, an isooxazolyl group, an isothiazolyl group, an imidazolyl group, an oxazolyl group, a thiazolyl group, a pyridazyl group, a pyrimidyl group, a pyradyl group, a tolyazolyl group, a tetrazolyl group, a benzooxazolyl group, benzoimidazolyl group, an isoquinolyl group, a thiadiazolyl group, a morpholino group, a piperidino group, a piperadino group, an indolyl group, an isoindolyl group, and a thiomorpholino group), a ureido group (such as a methyl ureido group, a dimethyl ureido group, and a phenyl ureido group), a sulfamoyl amino group (such as a dipropyl sulfamoyl amino group), an alkoxy carbonyl amino group (such as a dipropyl sulfamoyl amino group), an alkoxy carbonyl amino group (such as an ethoxy carbonyl amino group), an aryloxy carbonyl amino group (such as a phenyloxy carbonyl amino group), an alkyl sulfinyl group (such as a phenyl sulfinyl group), a silyl group (such as a trimethoxy silyl group, and a triethoxy silyl group), a silyloxy group (such as a trimethyl silyloxy group), or the like can be presented.

The above-mentioned carboxyl group, sulfo group, hydroxy group and phosphono group may form a salt. As a cation for forming the salt at the time, an organic cationic compound, a transition metal coordination complex cation (such as a compound disclosed in U.S. Pat. No. 2,791,143) or a metal cation (such as $Na^+$, $K^+$, $Li^+$, $Ag^+$, $Fe^{2+}$, $Fe^{3+}$, Cu+, $Cu^{2+}$, $Zn^{2+}$, $Al^{3+}$, and $1/2Ca^{2+}$) are preferable.

As the above-mentioned organic cationic compound, for example, a quaternary ammonium cation, a quaternary pyridinium cation, a quaternary quinolinium cation, a phosphonium cation, an iodonium cation, a sulfonium cation, a pigment cation, or the like can be presented.

As specific examples of the above-mentioned quaternary ammonium, a tetraalkyl ammonium cation (such as a tetramethyl ammonium cation, and a tetrabutyl ammonium cation), a tetraaryl ammonium cation (such as a tetraphenyl ammonium cation), or the like can be presented. As the above-mentioned quaternary pyridinium cation, an N-alkyl pyridinium cation (such as an N-methyl pyridinium cation), an N-aryl pyridinium cation (such as an N-phenyl pyridinium cation), an N-alkoxy pyridinium cation (such as a 4-phenyl-N-methoxy-pyridinium cation), an N-benzoyl pyridinium cation, or the like can be presented. As the above-mentioned quaternary quinolinium cation, an N-alkyl quinolinium cation (such as an N-methyl quinolinium cation), an N-aryl quinolinium cation (such as an phenyl quinolinium cation), or the like, can be presented. As the above-mentioned phosphonium cation, a tetraaryl phosphonium cation (such as a tetraphenyl phosphonium cation), or the like can be presented. As the above-mentioned iodonium cation, a diaryl iodonium cation (such as a diphenyl iodonium cation), or the like can be presented. As the above-mentioned sulfonium cation, a triaryl sulfonium cation (such as a triphenyl sulfonium cation), or the like can be presented.

Furthermore, as a cation for forming a salt, the compounds disclosed in the paragraphs [0020] to [0038] of JP-A No. 9-188686, or the like can be presented.

As the above-mentioned alkenyl group, straight chain-like, branched and ring-like alkenyl groups can be presented. The number of carbon atoms of the alkenyl group is preferably 2 to 30, and more preferably 2 to 20. As to the number of carbon atoms in the alkenyl part of the substituted alkenyl group, the above-mentioned range is preferable as well.

As specific examples of the above-mentioned alkenyl group, for example, a vinyl group, an allyl group, a prenyl group, a geranyl group, an oleyl group, a cycloalkenyl group (such as a 2-cyclopentene-1-yl group, and a 2-cyclohexene-1-yl group), a bicyclo [2,2,1] hepto-2-en-1-yl, a bicyclo [2,2,2] octo-2-en-4-yl, or the like can be presented.

As specific examples of the substituent of the substituted alkenyl group, the same substituents as in the case of the above-mentioned substituted alkyl group can be presented.

As the above-mentioned alkynyl group, straight chain-like, branched and ring-like alkynyl groups can be presented. The number of carbon atoms of the alkynyl group is preferably 2 to 30, and more preferably 2 to 20. As to the number of carbon atoms in the alkynyl part of the substituted alkynyl group, the above-mentioned range is preferable as well.

As specific examples of the above-mentioned alkynyl group, for example, an ethynyl group, a propargyl group, a trimethyl silyl ethynyl group, or the like can be presented.

As specific examples of the substituted alkynyl group, the same substituents as in the case of the above-mentioned alkyl group can be presented.

As the above-mentioned aralkyl group, straight chain-like, branched and ring-like aralkyl groups can be presented. The number of carbon atoms of the aralkyl group is preferably 7 to 35, and more preferably 7 to 25. As to the number of carbon atoms in the aralkyl part of the substituted aralkyl group, the above-mentioned range is preferable as well.

As specific examples of the above-mentioned aralkyl group, for example, a benzyl group, a methyl benzyl group, an octyl benzyl group, a dodecyl benzyl group, a hexadecyl benzyl group, a dimethyl benzyl group, an octyloxy benzyl group, an octadecyl amino carbonyl benzyl group, a chlorobenzyl group, or the like can be presented.

As specific examples of the substituted aralkyl group, the same substituents as in the case of the above-mentioned alkyl group can be presented.

Moreover, in the case $R^1$ and $R^2$, $R^3$ and $R^5$, $R^4$, $R^6$ to $R^9$, $R^{10}$ to $R^{14}$, $R^{31}$ and $R^{32}$, $R^{33}$ and $R^{34}$ represent an aromatic group, as the aromatic group, for example, an aryl group, and a substituted aryl group can be presented. The number of carbon atoms of the aryl group is preferably 6 to 30, and more preferably 6 to 20. As to the number of carbon atoms in the aryl part of the substituted aryl group, the above-mentioned range is preferable as well.

As specific examples of the above-mentioned aryl group, for example, a phenyl group, an α-naphthyl group, a β-naphthyl group, or the like can be presented.

These aromatic groups may have a substituent. As the substituent of the substituted aromatic group, the same substituents as in the case of the above-mentioned alkyl group can be presented.

Moreover, in the case $R^1$ and $R^2$, $R^3$ and $R^5$, $R^4$, $R^{10}$ to $R^{14}$, $R^{31}$ and $R^{32}$ represent a heterocyclic group, as the heterocyclic group, for example, heterocyclic groups containing a nitrogen atom, an oxygen atom, and a sulfur atom, such as a furil group, a thienyl group, a pyridyl group, a pyrazolyl group, an isooxazolyl group, an isooxazolyl group, an isothiazolyl group, an imidazolyl group, an oxazolyl group, a thiazolyl group, a pyridazyl group, a pyrimidyl group, a pyradyl group, a tolyazolyl group, a tetrazolyl group, a quinolyl group, a benzothiazolyl group, a benzooxazolyl group, benzoimidazolyl group, an isoquinolyl group, a thiadiazolyl group, a morpholino group, a piperidino group, a thiomorpholino group, a tetrahydro furfuryl group, a piperadino group, an indolyl group, an isoindolyl group, or the like can be presented.

These heterocyclic groups may have a substituent. As the substituent of the substituted heterocyclic group, the same substituents as in the case of the above-mentioned alkyl group can be presented.

Moreover, in the case $R^6$ to $R^9$, $R^{33}$ and $R^{34}$ represent an acyl group, as the acyl group, for example, an aliphatic acyl group, an aromatic acyl group, a heterocyclic acyl group, or the like can be presented. The number of carbon atoms of the acyl group is preferably 1 to 30, and more preferably 1 to 20. As to the number of carbon atoms in the acyl part of the substituted acyl group, the above-mentioned range is preferable as well.

As specific examples of the above-mentioned acyl group, for example, an acetyl group, a propionyl group, a pivaloyl group, a chloro acetyl group, a trifluoro acetyl group, a 1-methyl cyclo-propyl carbonyl group, a benzoyl group, a 4-methoxy benzoyl group, a pyridyl carbonyl group, a thenoyl group, or the like can be presented.

These acyl groups may have a substituent. As the substituent of the substituted acyl group, the same substituents as in the case of the above-mentioned substituted alkyl group can be presented.

In the case $R^6$ to $R^9$, $R^{33}$ and $R^{34}$ represent an alkoxy carbonyl group, as the alkoxy carbonyl group, for example, an alkoxy carbonyl group having a substituent and an unsubstituted alkoxy carbonyl group can be presented. The number of carbon atoms of the alkoxy carbonyl group is preferably 2 to 20.

As specific examples of the above-mentioned alkoxy carbonyl group, for example, a methoxy carbonyl group, an ethoxy carbonyl group, an allyloxy carbonyl group, a methoxy ethyl carbonyl group, an octyloxy carbonyl group, or the like can be presented. As the substituent of the alkoxy carbonyl group having a substituent, the same substituents as in the case of the above-mentioned substituted alkyl group can be presented.

In the case $R^6$ to $R^9$, $R^{33}$ and $R^{34}$ represent an aryloxy carbonyl group, as the aryloxy carbonyl group, for example, an aryloxy carbonyl group having a substituent and an unsubstituted aryloxy carbonyl group can be presented. The number of carbon atoms of the aryloxy carbonyl group is preferably 7 to 30.

As specific examples of the above-mentioned aryloxy carbonyl group, for example, a phenoxy carbonyl group, and a naphthoxy carbonyl group can be presented. As the substituent of the aryloxy carbonyl group having a substituent, the same substituents as in the case of the above-mentioned substituted alkyl group can be presented.

In the case $R^6$ to $R^9$, $R^{33}$ and $R^{34}$ represent a carbamoyl group, as the carbamoyl group, for example, a carbamoyl group having a substituent and an unsubstituted carbamoyl group can be presented. The number of carbon atoms of the carbamoyl group is preferably 1 to 20.

As specific examples of the above-mentioned carbamoyl group, for example, a carbamoyl group, a methyl carbamoyl group, a dimethyl carbamoyl group, or the like can be presented. As the substituent of the carbamoyl group having a substituent, the same substituents as in the case of the above-mentioned substituted alkyl group can be presented.

In the case $R^6$ to $R^9$, $R^{33}$ and $R^{34}$ represent an alkyl sulfonyl group, as the alkyl sulfonyl group, for example, an alkyl sulfonyl group having a substituent and an unsubstituted alkyl sulfonyl group can be presented. The number of carbon atoms of the alkyl sulfonyl group is preferably 1 to 20.

As specific examples of the above-mentioned alkyl sulfonyl group, for example, a methyl sulfonyl group, an ethyl sulfonyl group, a dodecyl sulfonyl group, a trifluoro methyl sulfonyl group, or the like can be presented. As the substituent of the alkyl sulfonyl group having a substituent, the same substituents as in the case of the above-mentioned substituted alkyl group can be presented.

In the case $R^6$ to $R^9$, $R^{33}$ and $R^{34}$ represent an aryl sulfonyl group, as the aryl sulfonyl group, for example, an aryl sulfonyl group having a substituent and an unsubstituted aryl sulfonyl group can be presented. The number of carbon atoms of the aryl sulfonyl group is preferably 6 to 30.

As specific examples of the above-mentioned aryl sulfonyl group, for example, a phenyl sulfonyl group, a toluene sulfonyl group, a chloro phenyl sulfonyl group, a methoxy phenyl sulfonyl group, an acetyl amino phenyl sulfonyl group, a naphthyl sulfonyl group, or the like can be presented. As the substituent of the aryl sulfonyl group having a substituent, the same substituents as in the case of the above-mentioned substituted alkyl group can be presented.

In the case $R^6$ to $R^9$, $R^{33}$ and $R^{34}$ represent a sulfamoyl group, as the sulfamoyl group, for example, an sulfamoyl group having a substituent and an unsubstituted sulfamoyl group can be presented.

As specific examples of the above-mentioned sulfamoyl group, for example, a sulfamoyl group, a dimethyl sulfamoyl group, a di(hydroxy ethyl)sulfamoyl group, or the like can be presented. As the substituent of the sulfamoyl group having a substituent, the same substituents as in the case of the above-mentioned substituted alkyl group can be presented.

In the case $R^1$ and $R^2$ link with each other so as to form a ring, as the linking group, an alkylene group having 2 to 4 carbon atoms is preferable. For example, an ethylene group, a propylene group, a butylenes group, or the like can be presented.

Among the compounds represented by the general formula (I) of the invention, those preferable as $R^1$ and $R^2$ are a hydrogen atom, an aliphatic group, —$COR^3$, —$COOR^4$, —$SO_2$—$R^5$, and —$N(R^6)R^7$. Those particularly preferable are a hydrogen atom, an alkyl group having 1 to 12 carbon atoms, a hydroxy group, which may have a substituent, or an alkyl group substituted by an amino group, —$COR^3$, —$COOR^4$, and —$N(R^6)R^7$.

As specific examples of these, a hydrogen atom, a methyl group, an ethyl group, a propyl group, a butyl group, a hexyl group, an octyl group, a dodecyl group, an octadecyl group, a hydroxy ethyl group, a hydroxy propyl group, a hydroxy ethoxy ethyl group, a hydroxy butyl group, a hydroxy octyl group, an amino ethyl group, an amino propyl group, —$(CH_2)2NH(CH_2)2NH_2$, a phenoxy ethyl group, a phenoxy propyl group, a diethyl amino ethyl group, an N-methyl-N-benzyl amino ethyl group, a phenyl group, a tolyl group, a methoxy phenyl group, a chloro phenyl group, an acetyl phenyl group, a biphenyl group, a naphthyl group, a pyridyl group, a morpholino group, a piperadino group, a pyrolidino group, a furfuryl group, an acetyl group, a carbamoyl group, an N,N-diethyl carbamoyl group, a benzoyl group, an ethoxy carbonyl group, a butyl amino carbonyl group, a phenyl amino carbonyl group, a phenoxy carbonyl group, a methyl sulfonyl group, a phenyl sulfonyl group, a toluene sulfonyl group, an aceto amino phenyl sulfonyl group, a chloro phenyl sulfonyl group, an amino group, a dimethyl amino group, a methyl amino group, an acetyl amino group, or the like can be presented.

Among the compounds represented by the general formula (I) of the invention, those preferable as $R^{10}$ to $R^{14}$ are a hydrogen atom, an aliphatic group, —$COOR^{32}$, and —$N(R^{33})R^{34}$. Those particularly preferable are a hydrogen atom, an aliphatic group having 1 to 12 carbon atoms, —$COOR^{32}$ having 20 or less carbon atoms, and —$N(R^{33})R^{34}$.

Specific examples of the compounds represented by the general formula (I) of the invention will be presented below, but the invention is not limited to these compounds.

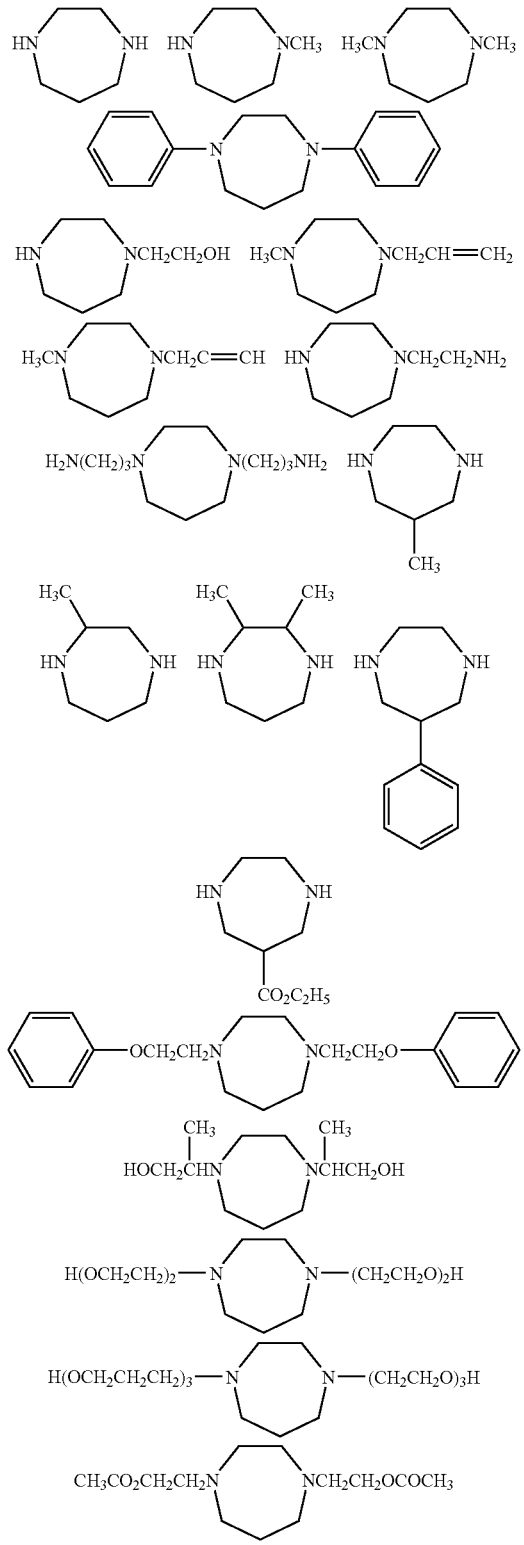

-continued

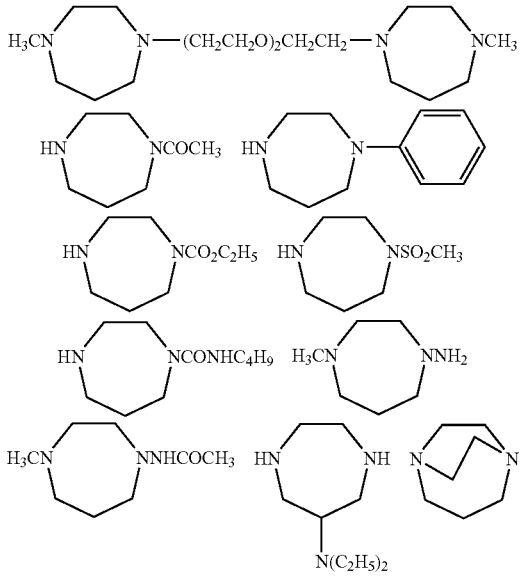

(Compound Represented by the General Formula (II))

According to the ink-jet recording sheet according to the second aspect of the invention, the color material accepting layer provided on the substrate contains a compound represented by the following general formula (II):

General formula (II)

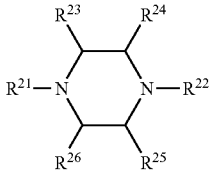

wherein, in the above-mentioned general formula (II), $R^{21}$ and $R^{22}$ each independently represent a hydrogen atom, an aliphatic group, an aromatic group, a heterocyclic group, —$COR^{53}$, —$COOR^{54}$, —$SO_2$—$R^{55}$, or —$N(R^{56})R^{57}$; $R^{53}$ and $R^{55}$ each independently represent a hydrogen atom, an aliphatic group, an aromatic group, a heterocyclic group, or —$N(R^{58})R^{59}$; $R^{54}$ represents a hydrogen atom, an aliphatic group, an aromatic group, or a heterocyclic group; $R^{56}$ to $R^{59}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; $R^{21}$ and $R^{22}$ may link with each other so as to form a ring; $R^{23}$ represents an aliphatic group, an aromatic group, a heterocyclic group, —$COR^{71}$, —$COOR^{72}$, —$N(R^{73})R^{74}$; $R^{24}$ through $R^{26}$ each independently represent a hydrogen atom, an aliphatic group, an aromatic group, a heterocyclic group, —$COR^{71}$, —$COOR^{72}$, or —$N(R^{73})R^{74}$; $R^{71}$ represents a hydrogen atom, an aliphatic group, an aromatic group, a heterocyclic group or —$N(R^{58})R^{59}$; $R^{72}$ represents a hydrogen atom, an aliphatic group, an aromatic group, or a heterocyclic group; $R^{73}$ and $R^{74}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group.

In the case $R^{21}$ and $R^{22}$, $R^{53}$ and $R^{55}$, $R^{54}$, $R^{56}$ to $R^{59}$, $R^{23}$, $R^{24}$ to $R^{26}$, $R^{71}$ and $R^{72}$, $R^{73}$ and $R^{74}$ represent an aliphatic group, as the aliphatic group, for example, the same aliphatic groups represented by $R^1$ and $R^2$, or the like in the above-mentioned general formula (I) can be presented. The preferable range of the number of carbon atoms, and preferable substituent examples are same as well.

In the case $R^{21}$ and $R^{22}$, $R^{53}$ and $R^{55}$, $R^{54}$, $R^{56}$ to $R^{59}$, $R^{23}$, $R^{24}$ to $R^{26}$, $R^{71}$ and $R^{72}$, $R^{73}$ and $R^{74}$ represent an aromatic group, as the aromatic group, for example, the same aromatic groups represented by $R^1$ and $R^2$, or the like in the above-mentioned general formula (I) can be presented. The preferable range of the number of carbon atoms, and preferable substituent examples are same as well.

In the case $R^{21}$ and $R^{22}$, $R^{53}$ and $R^{55}$, $R^{54}$, $R^{23}$, $R^{24}$ to $R^{26}$, $R^{71}$ and $R^{72}$ and $R^{74}$ represent a heterocyclic group, as the heterocyclic group, for example, the same heterocyclic groups represented by $R^1$ and $R^2$, or the like in the above-mentioned general formula (I) can be presented. The preferable range of the number of carbon atoms, and preferable substituent examples are same as well.

In the case $R^{56}$ to $R^{59}$, $R^{73}$ and $R^{74}$ represent an acyl group, an alkoxy carbonyl group, an aryloxy carbonyl group, a carbamoyl group, an alkyl sulfonyl group, an aryl sulfonyl group, or a sulfamoyl group, as the acyl group, the alkoxy carbonyl group, the aryloxy carbonyl group, the carbamoyl group, the alkyl sulfonyl group, the aryl sulfonyl group, and the sulfamoyl group, for example, the same acyl group, alkoxy carbonyl group, aryloxy carbonyl group, carbamoyl group, alkyl sulfonyl group, aryl sulfonyl group, and sulfamoyl group represented by $R^6$ to $R^9$, or the like in the above-mentioned general formula (I) can be presented. The preferable range of the number of carbon atoms, and preferable examples of the acyl group, the alkoxy carbonyl group, the aryloxy carbonyl group, the carbamoyl group, the alkyl sulfonyl group, the aryl sulfonyl group, and the sulfamoyl group are same as well.

In the case $R^{21}$ and $R^{22}$ link with each other so as to form a ring, as the linking group, for example, the same linking groups represented by $R^1$ and $R^2$ in the above-mentioned general formula (I) can be presented. The preferable range of the number of carbon atoms, and preferable linking group examples are same as well.

Among the compounds represented by the above-mentioned general formula (II), those represented by the following general formula (V) are preferable in terms of the ozone resistance and the deodorant property:

General formula (V)

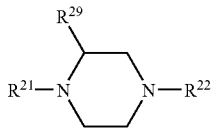

wherein, in the above-mentioned general formula (V), $R^{21}$ and $R^{22}$ are same as the substituents represented by $R^{21}$ and $R^{22}$ in the above-mentioned general formula (II), and preferable compound examples are same as well. $R^{29}$ represents an aliphatic group, —$COOR^{72}$, —$N(R^{73})R'4$. Those preferable are an alkyl group (such as a methyl group and an ethyl group), —COOH, —$CONH_2$, —$CONHNH_2$ and —$NH_2$, and particularly preferable is a methyl group.

(Compound Represented by the General Formula (III))

According to the ink-jet recording sheet according to the third aspect of the invention, the color material accepting layer provided on a substrate contains a compound represented by the following general formula (III), fine particles and a water soluble resin, and the solid component content of the fine particles in the color material accepting layer is more than 60% by mass:

General formula (III)

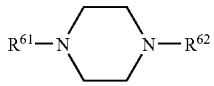

wherein, in the general formula (III), $R^{61}$ and $R^{62}$ each independently represent a hydrogen atom, an aliphatic group, an aromatic group, a heterocyclic group, —$COR^{63}$, —$COOR^{64}$, —$SO_2$—$R^{65}$, or —$N(R^{66})R^{67}$; $R^{63}$ and $R^{65}$ each independently represent a hydrogen atom, an aliphatic group, an aromatic group, a heterocyclic group, or —$N(R^{68})R^{69}$; $R^{64}$ represents a hydrogen atom, an aliphatic group, an aromatic group, or a heterocyclic group; $R^{66}$ through $R^{69}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; $R^{61}$ and $R^{62}$ may link with each other so as to form a ring.

In the case $R^{61}$ and $R^{62}$, $R^{63}$ and $R^{65}$, $R^{64}$, and $R^{66}$ through $R^{69}$ represent an aliphatic group, as the aliphatic group, for example, the same aliphatic groups represented by $R^1$ and $R^2$, or the like in the above-mentioned general formula (I) can be presented. The preferable range of the number of carbon atoms, and preferable aliphatic group examples are same as well.

In the case $R^{61}$ and $R^{62}$, $R^{63}$ and $R^{65}$, $R^{64}$, and $R^{66}$ to $R^{69}$ represent an aromatic group, as the aromatic group, for example, the same aromatic groups represented by $R^1$ and $R^2$, or the like in the above-mentioned general formula (I) can be presented. The preferable range of the number of carbon atoms, and preferable aromatic group examples are same as well.

In the case $R^{61}$ and $R^{62}$, $R^{63}$ and $R^{65}$, and $R^{64}$ represent a heterocyclic group, as the heterocyclic group, for example, the same heterocyclic groups represented by $R^1$ and $R^2$, or the like in the above-mentioned general formula (I) can be presented. The preferable range of the number of carbon atoms, and preferable heterocyclic group examples are same as well.

In the case $R^{66}$ to $R^{69}$ represent an acyl group, an alkoxy carbonyl group, an aryloxy carbonyl group, a carbamoyl group, an alkyl sulfonyl group, an aryl sulfonyl group, or a sulfamoyl group, as the acyl group, the alkoxy carbonyl group, the aryloxy carbonyl group, the carbamoyl group, the alkyl sulfonyl group, the aryl sulfonyl group, and the sulfamoyl group, for example, the same acyl group, alkoxy carbonyl group, aryloxy carbonyl group, carbamoyl group, alkyl sulfonyl group, aryl sulfonyl group, and sulfamoyl group represented by $R^6$ to $R^9$, or the like in the above-mentioned general formula (I) can be presented. The preferable range of the number of carbon atoms, and preferable examples of the acyl group, the alkoxy carbonyl group, the aryloxy carbonyl group, the carbamoyl group, the alkyl sulfonyl group, the aryl sulfonyl group, and the sulfamoyl group are same as well.

In the case $R^{61}$ and $R^{62}$ link with each other so as to form a ring, as the linking group, for example, the same linking groups represented by $R^1$ and $R^2$ in the above-mentioned general formula (I) can be presented. The preferable range of the number of carbon atoms, and preferable linking group examples are same as well.

In the compounds represented by the general formula (III) of the invention, it is preferable that at least one of $R^{61}$ and $R^{62}$ is a hydroxy group or an alkyl group substituted by an amino group, which may have a substituent, —$COR^{63}$, —$COOR^{64}$, —$SO_2$—$R^{65}$, or —$N(R^{66})R^{67}$ in terms of the ozone resistance and the deodorant property.

The compounds represented by the general formula (III) of the invention are particularly preferably those represented by the following general formulae (VI) and (VII) in terms of the ozone resistance:

General formula (VI)

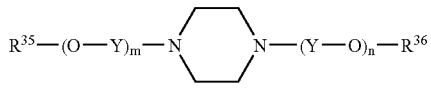

General formula (VII)

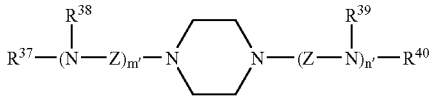

wherein, in the above-mentioned general formula (VI), $R^{35}$ and $R^{36}$ each independently represent a hydrogen atom, an aliphatic group, an acyl group, an alkoxy carbonyl group, an aryloxy carbonyl group, a carbamoyl group, an alkyl sulfonyl group, an aryl sulfonyl group, or a sulfamoyl group. Y represents a strait chain-like, branched or cyclic alkylene group having 2 to 4 carbon atoms. M represents an integer from 0 to 10, and n represents an integer from 1 to 10.

In the above-mentioned general formula (VII), $R^{37}$ and $R^{40}$ each independently represent a hydrogen atom, an aliphatic group, an acyl group, an alkoxy carbonyl group, an aryloxy carbonyl group, a carbamoyl group, an alkyl sulfonyl group, an aryl sulfonyl group, or a sulfamoyl group. $R^{38}$ and $R^{39}$ each independently represent a hydrogen atom, or an aliphatic group. Z represents a strait chain-like or branched alkylene group having 2 to 4 carbon atoms. M' represents an integer from 0 to 10, and n' represents an integer from 1 to 10.

Among the compounds represented by the above-mentioned general formulae (VI) and (VII), those represented by the general formula (VII) are particularly preferable in terms of the ozone resistance improving effect.

(Compound Represented by the General Formula (IV))

According to the ink-jet recording sheet according to the fourth aspect of the invention, the color material accepting layer provided on a substrate contains a compound represented by the following general formula (IV), fine particles and a water soluble resin, and the solid component content of the fine particles in the color material accepting layer is more than 60% by mass:

General formula (IV)

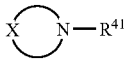

wherein, in the general formula (IV), $R^{41}$ represents a hydrogen atom, an aliphatic group, an aromatic group, a heterocyclic group, —$COR^{43}$, —$COOR^{44}$, —$SO_2$—$R^{45}$, or —$N(R^{46})R^{47}$; $R^{43}$ and $R^{45}$ each independently represent a hydrogen atom, an aliphatic group, an aromatic group, a heterocyclic group, or —$N(R^{48})R^{49}$; $R^{44}$ represents a hydrogen atom, an aliphatic group, an aromatic group, or a heterocyclic group; $R^{46}$ to $R^{49}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; X represents an atom group necessary for forming a 5- to 7-membered ring of a saturated hydrocarbon, which may include an oxygen atom, a sulfur atom, SO or $SO_2$; $R^{41}$ and the atom group represented by X may link with each other so as to form a ring.

In the case $R^{41}$, $R^{43}$ and $R^{45}$, $R^{44}$, and $R^{46}$ to $R^{49}$ represent an aliphatic group, as the aliphatic group, for example, the same aliphatic groups represented by $R^1$ and $R^2$, or the like in the above-mentioned general formula (I) can be presented. The preferable range of the number of carbon atoms, and preferable aliphatic group examples are same as well.

In the case $R^{41}$, $R^{43}$ and $R^{45}$, $R^{44}$, and $R^{46}$ through $R^{49}$ represent an aromatic group, as the aromatic group, for example, the same aromatic groups represented by $R^1$ and $R^2$, or the like in the above-mentioned general formula (I) can be presented. The preferable range of the number of carbon atoms, and preferable aromatic group examples are same as well.

In the case $R^{41}$, $R^{43}$ and $R^{4\text{-}5}$, and $R^{44}$ represent a heterocyclic group, as the heterocyclic group, for example, the same heterocyclic groups represented by $R^1$ and $R^2$, or the like in the above-mentioned general formula (I) can be presented. The preferable range of the number of carbon atoms, and preferable heterocyclic group examples are same as well.

In the case $R^{46}$ through $R^{49}$ represent an acyl group, an alkoxy carbonyl group, an aryloxy carbonyl group, a carbamoyl group, an alkyl sulfonyl group, an aryl sulfonyl group, or a sulfamoyl group, as the acyl group, the alkoxy carbonyl group, the aryloxy carbonyl group, the carbamoyl group, the alkyl sulfonyl group, the aryl sulfonyl group, and the sulfamoyl group, for example, the same acyl group, alkoxy carbonyl group, aryloxy carbonyl group, carbamoyl group, alkyl sulfonyl group, aryl sulfonyl group, and sulfamoyl group represented by $R^6$ through $R^9$, or the like in the above-mentioned general formula (I) can be presented. The preferable range of the number of carbon atoms, and preferable examples of the acyl group, the alkoxy carbonyl group, the aryloxy carbonyl group, the carbamoyl group, the alkyl sulfonyl group, the aryl sulfonyl group, and the sulfamoyl group are same as well.

In the compounds represented by the general formula (IV) of the invention, as $R^{41}$, an aliphatic group, —$COR^{43}$, $COOR^{44}$, and —$N(R^{46})R^{47}$ are preferable. Furthermore, from the viewpoint of further improvement of the ozone resistance, $R^{41}$ is preferably —(—Y—O—)n-$R^{48}$, -(-Z-$NR^{49}$—)n'-$R^{50}$, particularly preferably -(-Z-$NR^{49}$—)n'-$R^{50}$. Here, $R^{48}$ represents a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, and a sulfamoyl group. $R^{49}$ and $R^{50}$ represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, and a sulfamoyl group.

Although the EP 1,138,509 presents those including a thio ether bond as an alkyl group substituted by N as a compound example (36) as an analogous substance of the general formula (IV) of the invention, the above-mentioned compound example (36) shows only the gas resistance (ozone resistance) equivalent to a compound example (7) not having an alicyclic amino group in the example probably due to decomposition of the compound by prior ozone oxidization of the thio ether bond. Therefore, in the case R 41 of the general formula (IV) of the invention represents an alkyl group, it is one not including a thio ether bond.

X represents an atom group necessary for forming 5- to 7-membered ring of a saturated hydrocarbon, which may include an oxygen atom, a sulfur atom, an SO or an $SO_2$. Among these examples, as the linking ring of the general formula (IV), the following 5- to 7-membered rings are preferable.

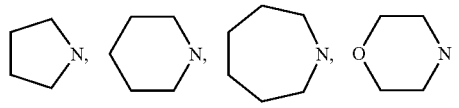

Here, the above-mentioned 5- to 7-membered rings may have a substituent represented by $R^{10}$ of the above-mentioned general formula (I).

Hereafter, specific examples of the compounds represented by the general formulae (II) to (IV) of the invention will be presented, but the invention is not limited to the compounds.

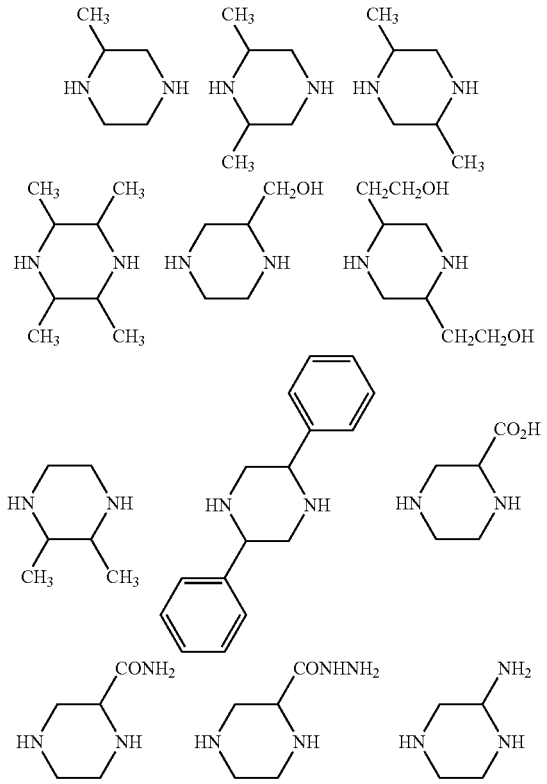

-continued
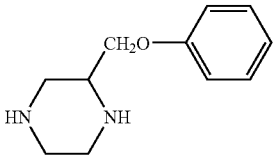
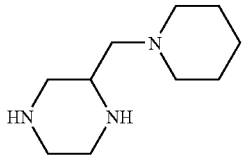
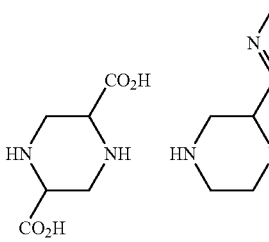
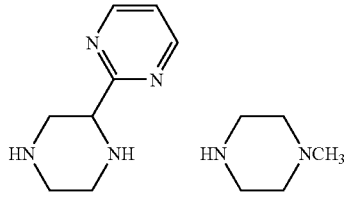
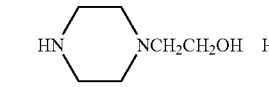
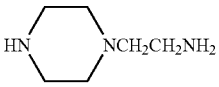
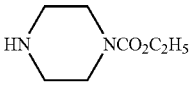
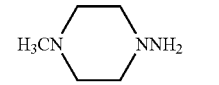
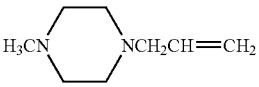
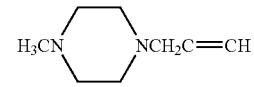
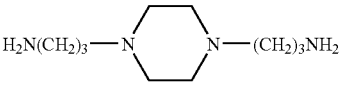
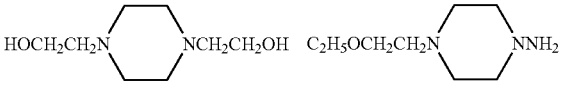
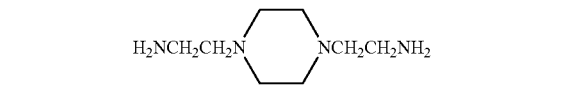
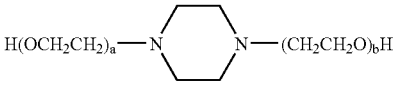
a: 3~5
b: 3~5
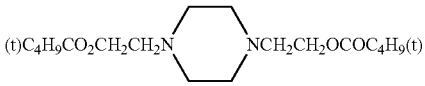
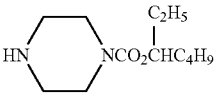
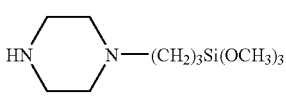
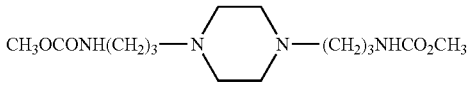
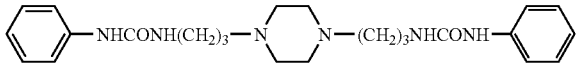
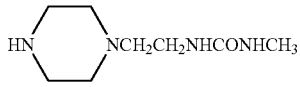
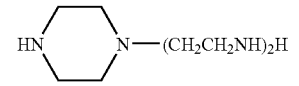
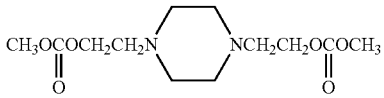
-continued
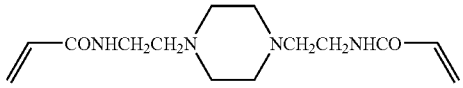
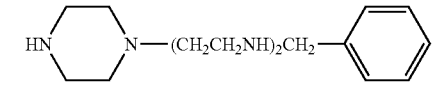
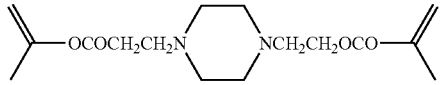
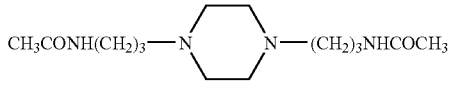
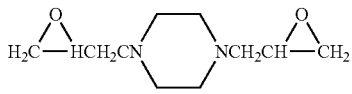
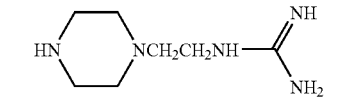
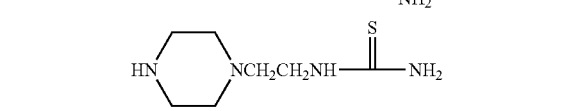
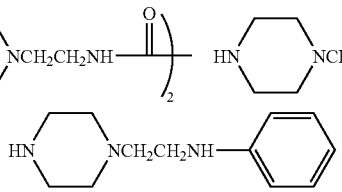
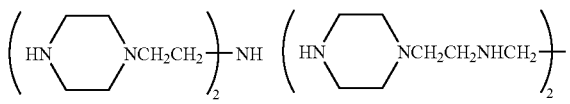
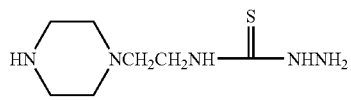
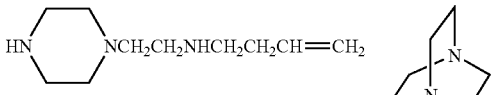
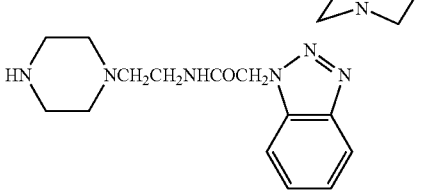
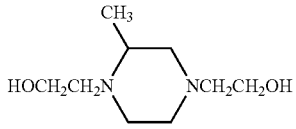
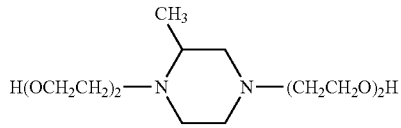
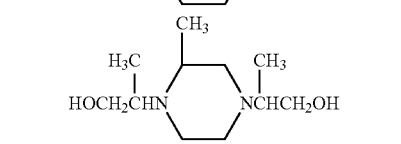

-continued

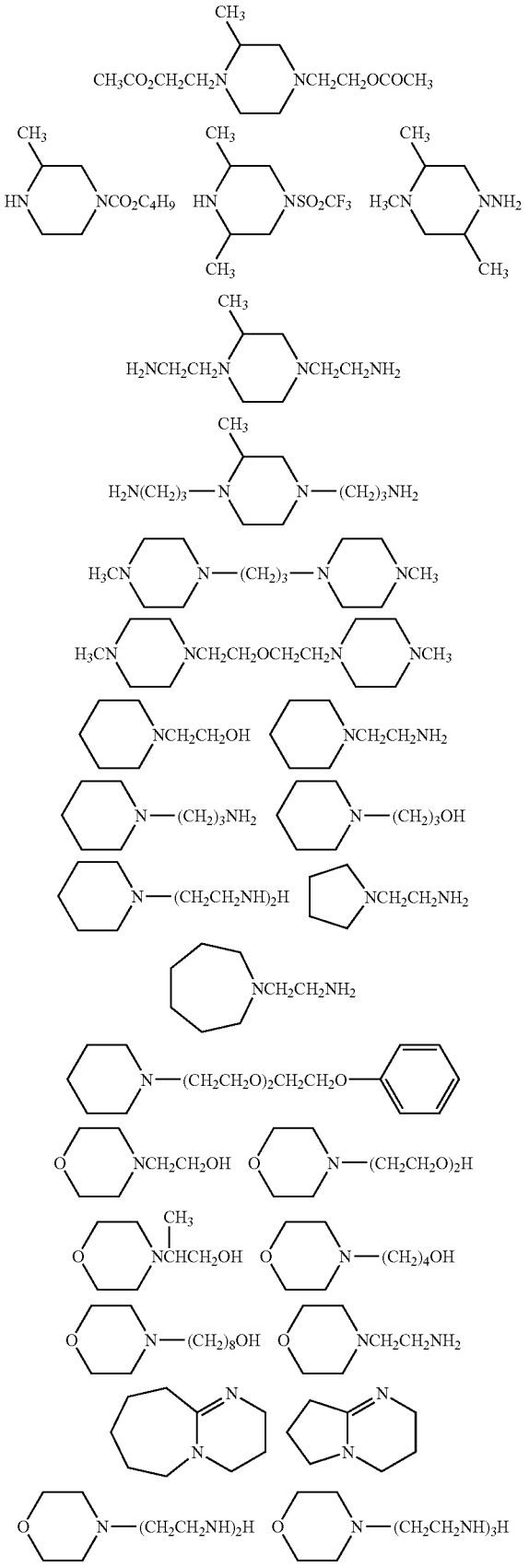

-continued

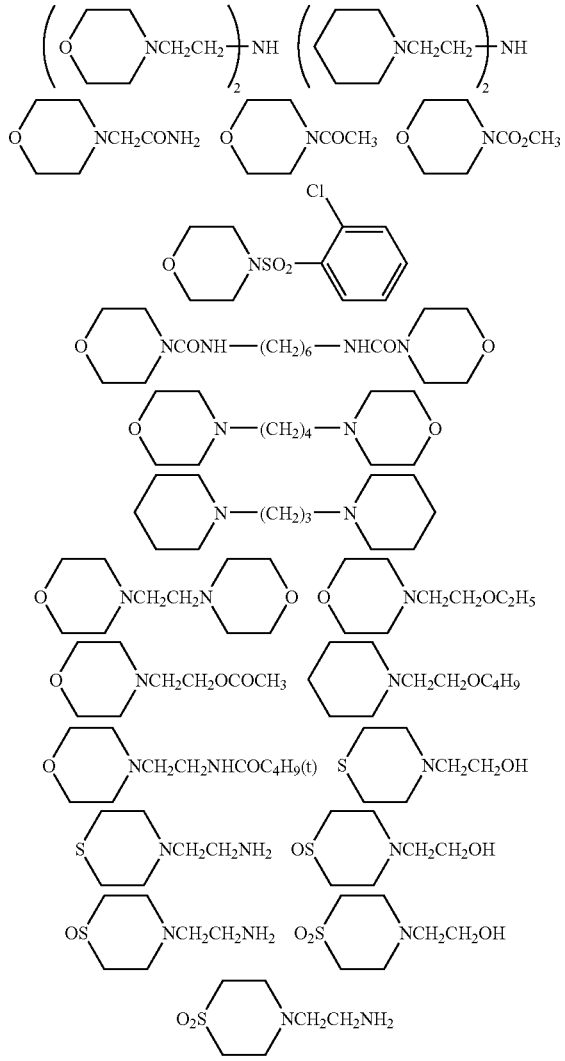

The compounds represented by the general formulae (I) to (IV) may either be water soluble or oil soluble, but it is preferable to use a water soluble compound since it is advantageous in terms of providing the production suitability and the resistance to the ink-jet recording sheet. The dissolubility to water is preferably 0. 1 g or more with respect to 100 g of water at 25° C., particularly preferably 0.5 g or more.

At the time of including a compound represented by the general formulae (I) to (IV) in a color material accepting layer, it may be added in a state with the affinity to water improved by mixing a water soluble organic solvent, such as an alcohol compound (such as a methanol, an ethanol, an isopropyl alcohol, an ethylene glycol, a diethylene glycol, a diethylene glycol monobutyl ether, a polyethylene glycol, a polypropylene glycol, a glycerol, a diglycerol, a trimethylol propane, and a trimethylol butane), an ether compound (such as a tetrahydro furan, and a dioxane), an amide compound (such as a dimethyl formamide, a dimethyl acetamide, and an N-methyl pyrrolidone), a ketone compound (such as an acetone), or the like.

In the case the compounds represented by the general formulae (I) to (IV) do not have a sufficient water solubility, a hydrophobic organic solvent, such as an ester compound (such as an ethyl acetate, a dioctyl adipate, a butyl phthalate, a methyl stearate, and a tricresyl phosphate), an ether compound (such as an anisole, a hydroxy ethoxy benzene, and a hydroquinone dibutyl ether), a hydrocarbon compound (such as a toluene, a xylene, and a diisopropyl naphthalene), an alcohol compound (such as a 2-ethyl hexyl alcohol, a benzyl alcohol, and a phenethyl alcohol), a ketone compound (such as a hydroxy acetophenone, a benzophenone, and a cyclo hexane), the above-mentioned water soluble organic solvents, or the like may be added and mixed. As to the form of addition, oil drop, latex, solid dispersion, polymer dispersion, or the like may be employed.

The compounds represented by the general formulae (I) to (IV) may form an oligomer or a polymer with the alicyclic amine in the general formulae (I) to (IV) serving as a partial skeleton. At the time, in the case a reactive group exists in the general formulae (I) to (IV), it is also possible to produce an oligomer or a polymer by reacting the same with a halogen compound, a tosylate compound, an isocyanate compound, an epoxy compound, an acidic halide compound, or the like having 2 or more functional groups.

It can be carried out by homopolymerization, another polymerization, or copolymerization with a reacting agent. Or the general formulae (I) to (IV) having a reactive group, such as a methacrylic group, an acrylic group, an epoxy group, a reactive cyclic ether group, and a vinyl group may be homopolymerized or copolymerized with another monomer.

In the case a low molecular weight compound of the general formulae (I) to (IV) is used, the molecular weight is 1,000 or less, preferably 500 or less. In the case an oligomer and a polymer is used, the molecular weight is 1,200 or more, preferably 2,000 or more.

An ink-jet recording sheet of the invention may include at least one kind of the compounds represented by the above-mentioned general formulae (I) to (IV) in a color material accepting layer.

The content of the compounds represented by the general formulae (I) to (IV) in the color material accepting layer is preferably 0.01 g/m2 to 5 g/m2, more preferably 0.05 g/m2 to 3 g/m2.

(Fine Particles)

According to the ink-jet recording sheets according to the third and fourth aspects of the invention, the color material accepting layer provided on a substrate contains a compound represented by the above-mentioned general formula (III) or (IV), fine particles and a water soluble resin later described, and the solid component content of the fine particles in the color material accepting layer is more than 60% by mass. Moreover, also in the ink-jet recording sheets according to the first and second aspects of the invention, it is preferable that the color material accepting layer contains fine particles and a water soluble resin together with a compound represented by the above-mentioned general formula (I) or (II).

Since the color material accepting layer contains fine particles, a porous structure can be obtained. Thereby, the ink absorbing performance can be improved. In particular, in the case the solid component content in the color material accepting layer of the fine particles is more than 60% by mass, more preferably 65% by mass, a further preferable porous structure can be formed so that an ink-jet recording sheet having a sufficient ink absorbing property can be obtained, and thus it is preferable. Here, the solid component content in the color material accepting layer of the fine particles denotes the content calculated based on the components other than water in the composition comprising the color material accepting layer.

As the above-mentioned fine particles of the invention, organic fine particles and inorganic fine particles can be used. In terms of the ink absorbing property and the image stability, it is preferable to contain inorganic fine particles.

As the above-mentioned organic fine particles, for example, polymer fine particles obtained by emulsion polymerization, micro-emulsion polymerization, soap free polymerization, seed polymerization, dispersion polymerization, condensation polymerization, or the like are preferable. Powders of for example, a polyethylene, a polypropylene, a polystyrene, a polyacrylate, a polyamide, a silicone resin, a phenol resin, a natural polymer, or the like, a latex or emulsion-like polymer fine particles, or the like can be presented.

As the above-mentioned inorganic fine particles, for example, silica fine particles, a colloidal silica, a titanium dioxide, a barium sulfate, a calcium silicate, a zeolite, a kaolinite, a halloysite, a mica, a talc, a calcium carbonate, a magnesium carbonate, a calcium sulfate, a quasi boehmite, a zinc oxide, a zinc hydroxide, an alumina, an aluminum silicate, a calcium silicate, a magnesium silicate, a zirconium oxide, a zirconium hydroxide, a cerium oxide, a lanthanum oxide, yttrium oxide, or the like can be presented. Among these examples, in terms of forming a preferable porous structure, silica fine particles, a colloidal silica, alumina fine particles, and a quasi boehmite are preferable. The fine particles may be used as primary particles or in a state with secondary particles formed. The average primary particle size of the fine particles is preferably 2 μm or less, more preferably 200 nm or less.

Furthermore, silica fine particles having 20 nm or less average primary particle size, alumina fine particles having 20 nm or less average primary particle size, or a quasi boehmite having a 2 to 15 nm average porous radius are more preferable, and silica fine particles are particularly preferable.

The silica fine particles can in general be classified into wet method particles and dry method (gas phase method) particles on the whole according to the production method. According to the above-mentioned wet method, a method of obtaining a silica hydrate by producing an active silica by the acid decomposition of a silicate, appropriate polymerization of the same, aggregation and precipitation is the mainstream. In contrast, according to the gas phase method, a method of high temperature gas phase hydrolysis of a silica halide (flame hydrolysis method), and a method of obtaining a silica anhydrate by heating, reduction and gasification of silica sand and coke by arc in an electric furnace, and acidify the same by the air (arc method) are the mainstream. The "gas phase method silica" denotes silica anhydrate fine particles obtained by the gas phase method. As the silica fine particles used in the invention, the gas phase method silica fine particles are particularly preferable.

Since the above-mentioned gas phase method silica is different from the silica hydrate in terms of the concentration of the surface silanol group, existence or absence of holes, or the like, each of them has different natures, however, it is suitable for forming a three-dimensional structure with a high void ratio. Although the reason is not apparent, in the case of a silica hydrate, the silanol group concentration on the fine particle surface is as large as 5 to 8 pieces/$nm^2$ so that the silica fine particles can easily be aggregated densely. In contrast, in the case of a gas phase method silica, since the silanol group concentration on the fine particle surface is as small as 2 to 3 pieces/$nm^2$, it provides non-dense flocculation. It is presumed that a structure with a high void ratio is provided as a result.

It is characteristic of the above-mentioned gas phase method silica that high ink absorbing property and keeping efficiency can be provided owing to its particularly large specific surface area, and transparency can be provided to the coloring material accepting layer by dispersion to an appropriate particle size owing to its low refractive index so that a high color density and a good color developing property can be obtained. Transparency of the color material accepting layer is important from the viewpoint of obtainment of a high color density and a good color developing property not only in the application requiring the transparency such as the OHP, but also in the case of use for a recording sheet such as a photo glossy paper.

The average primary particle size of the above-mentioned gas phase method silica is preferably 30 nm or less, more preferably 20 nm, particularly preferably 10 nm or less, and most preferably 3 to 10 nm. Since the particles can easily be adhered with each other by the hydrogen bond by the silanol group in the above-mentioned gas phase method silica, a structure with a high void ratio can be provided in the case of a 30 nm or less average primary particle size. Thereby, the ink absorbing characteristic can be improved effectively.

Moreover, the silica fine particles may be used in combination with the above-mentioned other fine particles. In the case the other fine particles and the above-mentioned gas phase method silica are used in a combination, the content of the gas phase method silica in the total fine particles is preferably 30% by mass or more, more preferably 50% by mass or more.

As the inorganic fine particles of the invention, an alumina, an alumina hydrate, and a mixture or a composite substance thereof are also preferable. Among these examples, an alumina hydrate is more preferable for its ability of preferably absorbing and fixing an ink. In particular, a quasi boehmite ($Al_2O_3.nH_2O$) is preferable. As the alumina hydrate, those of various forms can be used, but it is preferable to use a sol-like boehmite as the material since a smooth layer can be obtained easily.

As the pore characteristic of the quasi boehmite, the average pore radius is preferably 1 to 30 nm, more preferably 2 to 15 nm. Moreover, the pore volume thereof is preferably 0.3 to 2.0 cc/g, more preferably 0.5 to 1.5 cc/g. Here, the above-mentioned measurement of the porous radius and the porous volume can be carried out by the nitrogen adsorption and desorption method, using for example a gas adsorption and desorption analyzer (such as the product name. "Omni Soap 369" produced by Coalter Corp.).

Moreover, among the alumina, gas phase alumina fine particles are preferable for their large specific surface area. The average primary particle size of the gas phase alumina is preferably 30 nm or less, further preferably 20 nm or less.

In the case the above-mentioned fine particles are used for an ink-jet recording sheet, they can also be used preferably in the embodiments disclosed for example in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777, 2001-301314, or the like.

(Water Soluble Resin)

According to the ink-jet recording sheets according to the third and fourth aspects of the invention, the color material accepting layer contains a compound represented by the above-mentioned general formula (III) or (IV), the above-mentioned fine particles and a water soluble resin later. Moreover, also in the ink-jet recording sheets according to the first and second aspects of the invention, it is preferable that the color material accepting layer contains fine particles and a water soluble resin together with a compound represented by the above-mentioned general formula (I) or (II).

As the above-mentioned water soluble resin, for example, a resin having a hydroxy group as a hydrophilic structure unit, such as a polyvinyl alcohol (PVA), an acetoacetyl modified polyvinyl alcohol, a cation modified polyvinyl alcohol, an anion modified polyvinyl alcohol, a silanol modified polyvinyl alcohol, a polyvinyl acetal, a cellulose based resin [such as a methyl cellulose (MC), an ethyl cellulose (EC), a hydroxy ethyl cellulose (HEC), a carboxy methyl cellulose (CMC), and a hydroxy propyl cellulose (HPC)], chitins, chitosans, and a starch; a resin having an ether bond, such as a polyethylene oxide (PEO), a polypropylene oxide (PPO), a polyethylene glycol (PEG), and a polyvinyl ether (PVE); a resin having an amide group or a amide bond, such as a polyacrylic amide (PAAM), a polyvinyl pyrrolidone (PVP), and a hydrazide polyacrylate, or the like can be presented.

Moreover, one having a carboxyl group as a dissociating group, such as a polyacrylic acid salt, a maleic acid resin, an alginic acid salt, and gelatins can be presented as well.

Among the above-mentioned examples, a polyvinyl alcohol and a derivative thereof are preferable. As the examples of the polyvinyl alcohol, those disclosed in the Japanese Patent Application Publication (JP-B) Nos. 4-52786, 5-67432, and 7-29479, U.S. Pat. No. 2,537,827, the JP-B No. 7-57553, U.S. Pat. Nos. 2,502,998, and 3,053,231, the JP-A No. 63-176173, U.S. Pat. No. 2,604,367, JP-A Nos. 7-276787, 9-207425, 11-58941, 2000-135858, 2001-205924, 2001-287444, 62-278080, and 9-39373, U.S. Pat. No. 27,550,433, JP-A Nos. 2000-258801, 2001-213045, 2001-328345, 8-324105, 11-348417, or the like can be used as well.

The content of the water soluble resin of the invention is preferably 9 to 40% by mass with respect to the total solid component mass of the color material accepting layer, more preferably 12 to 33% by mass.

The above-mentioned fine particles and the above-mentioned water soluble resin mainly comprising the color material accepting layer each may be provided as a single material or as a mixture of a plurality of materials.

Furthermore, from the viewpoint of maintenance of the transparency, the kind of the water soluble resin used in a combination with the fine particles, in particular silica fine particles is important. In the case the above-mentioned gas phase method silica is used, as the water soluble resin, a polyvinyl alcohol (PVA) is preferable, in particular, a PVA having a 70 to 100% saponification degree is more preferable, and a PVA having a 80 to 99.5% saponification degree is particularly preferable.

The above-mentioned polyvinyl alcohol (PVA) has a hydroxyl group in the structure unit thereof. The hydroxyl group and the silanol group on the surface of the silica fine particles form a hydrogen bond so as to facilitate formation of a three-dimensional mesh structure with the secondary particles of the silica fine particles as the chain unit. It is considered that according to the formation of the three-dimensional mesh structure, a color material accepting layer having a porous structure and sufficient strength with a high void ratio can be formed.

In ink-jet recording, a porous color material accepting layer obtained as mentioned above absorbs an ink rapidly by the capillary tube phenomenon so as to form dots with a good roundness without ink blurring.

Moreover, it can be used in a combination with other water soluble resins such as a resin having a hydroxy group as a hydrophilic structure unit, such as a polyvinyl acetal, a cellulose based resin [such as a methyl cellulose (MC), an ethyl cellulose (EC), a hydroxy ethyl cellulose (HEC), a carboxy methyl cellulose (CMC), and a hydroxy propyl cellulose (HPC)], chitins, chitosans, and a starch; a resin having an ether bond, such as a polyethylene oxide (PEO), a polypropylene oxide (PPO), a polyethylene glycol (PEG), and a polyvinyl ether (PVE); a resin having an amide group or a amide bond, such as a polyacrylic amide (PAAM), a polyvinyl pyrrolidone (PVP), and a hydrazide polyacrylate, and one having a carboxyl group as a dissociating group, such as a polyacrylic acid salt, a maleic acid resin, an alginic acid salt, and gelatins. In the case the other water soluble resin and the above-mentioned polyvinyl alcohol are used in a combination, the content of the polyvinyl alcohol in the total water soluble resin is preferably 50% by mass or more, more preferably 70% by mass or more.

<Content Ratio of the Fine Particles and the Water Soluble Resin>

The mass content ratio of the fine particles (x) and the water soluble resin (y) [PB ratio (x/y)] provides a significant influence to the film structure and the film strength of the color material accepting layer. That is, with a large mass content ratio [PB ratio], the void ratio, the pore volume, and the surface area (per unit mass) are made larger, however, the density and the strength tend to be lowered.

The above-mentioned mass content ratio [PB ratio (x/y))] of the color material accepting layer of the invention is preferably 1.5:1 to 10:1 from the viewpoint of prevention of deterioration of the film strength and cracking generated at the time of drying due to too large a PB ratio, and easy generation of choking of the gaps by the resin and deterioration of the ink absorbing property derived from reduction of the void ratio due to too small a PB ratio.

In the case of passing through a conveyance system of an ink-jet printer, since a stress may be applied to a recording sheet, the color material accepting layer should have sufficient film strength. Moreover, in the case of applying a cutting process into a sheet-like form, the color material accepting layer should have sufficient film strength also in terms of prevention of cracking, peel off, or the like of the color material accepting layer. In consideration of these cases, the above-mentioned mass content ratio (x/y) is more preferably 5:1 or less. In contrast, from the viewpoint of ensuring the high speed ink absorbing property in the ink-jet printer, it is more preferably 2:1 or more.

For example, in the case a coating solution obtained by dispersing gas phase method silica fine particles having a 20 nm or less average primary particle size and a water soluble resin in an aqueous solution by a 2:1 to 5:1 mass ratio (x/y) is coated on a substrate and dried, a three-dimensional mesh structure with secondary particles of the silica fine particles as the chain unit is formed so that a light transmittable porous film having a 30 nm or less average pore size, a 50% to 80% void ratio, a 0.5 ml/g or more pore ratio volume and a 100 $m^2/g$ or more specific surface area can easily be formed.

(Cross-linking Agent)

It is preferable that a color material accepting layer for an ink-jet recording sheet of the invention is of an embodiment as a layer further containing a cross-linking agent capable of cross-linking the water soluble resin in a coating layer (porous layer) containing fine particles and a water soluble resin, and it is a layer hardened by the cross-linking reaction of the cross-linking agent and the water soluble resin.

The above-mentioned addition of the cross-linking agent is executed preferably in advance of the coating operation of the coating solution (coating solution for a color material accepting layer; hereinafter it may be referred to as a "coating solution (A)") for forming the porous color material accepting layer, simultaneously therewith, or before the coating layer formed by coating the coating solution for a color material accepting layer shows the decreasing rate of drying. According to the operation, generation of cracking during drying of the above-mentioned coating layer can be prevented effectively. That is, at the time of adding the cross-linking agent to the above-mentioned coating solution in advance, simultaneously with coating of the coating solution, or before having the decreasing rate of drying in the coating layer, the solution containing the cross-linking agent (cross-linking agent solution; hereinafter it may be referred to as a "solution (B)") permeates into the coating layer so as to be reacted quickly with the water soluble resin in the coating layer for gelling (hardening) the water soluble resin. Thereby, the film strength of the coating layer can instantaneously be improved dramatically.

Moreover, in the invention, a method of forming a color material accepting layer by coating on the substrate surface a coating solution obtained by adding a solution containing at least the above-mentioned water soluble resin (first solution) in an aqueous dispersion containing the above-mentioned fine particles and dispersing agent so as to be re-dispersed (hereinafter, it maybe referred to as a "coating solution (C)"), and applying on the above-mentioned coating layer a solution containing at least a mordanting agent (second solution; hereinafter it may be referred to as a "solution (D)") simultaneously with the coating operation, or during the drying operation of the coating layer formed by the coating operation and before the coating layer shows the decreasing rate of drying can be used preferably as well. In the case the method is used, it is preferable to add a cross-linking agent to at least one of the above-mentioned aqueous dispersion containing the fine particles and the dispersing agent, and the second solution to be applied later.

For cross-linking of the above-mentioned water soluble resin, in particular, a polyvinyl alcohol, a boron compound is preferable. As the boron compound, for example, a borax, a boric acid, a borate (such as an orthoborate, an $InBO_3$, an $ScBO_3$, an $YBO_3$, $LaBO_3$, an $Mg_3(BO_3)_2$, and a $Co_3(BO_3)_2$), a diborate (such as an $Mg_2B_2O_5$ and a $Co_2B_2O_5$), a methborate (such as an $LiBO_2$, a $Ca(BO_2)_2$, an $NaBO_2$, and a $KBO_2$), a tetraborate (such as an $Na_2B_4O_4.10H_2O$), and a pentaborate (such as a $KB_5O_8.4H_2O$, a $Ca_2B_6O_{11}.7H_2O$, and a $CsB_5O_5$) can be presented. Among these examples, for ability of quickly causing the cross-linking reaction, a borax, a boric acid, and a borate are preferable, and a boric acid is particularly preferable.

As a cross-linking agent for the above-mentioned water soluble resin, the following compounds other than the boron compounds can be used as well.

For example, an aldehyde compound such as a formaldehyde, a glyoxal, and a glutaraldehyde; a ketone based compound such as a diacetyl and a cyclopentane dione; an active halogen compound such as a bis(2-chloro ethyl urea)-2-hydroxy-4,6-dichloro-1,3,5-triazine, and a 2,4-dichloro-6-S-triazine.sodium salt; an active vinyl compound such as a divinyl sulfonic acid, a 1,3-vinyl sulfonyl-2-propanol, an N,N'-ethylene bis(vinyl sulfonyl acetamide), and a 1,3,5-triacryloyl-hexahydro-S-triazine; an N-methylol compound such as a dimethylol urea, and a methylol dimethyl hydantoin; a melamine resin (such as a methylol melamine, an alkylated methylol melamine); an epoxy resin; an isocyanate based compound such as a 1,6-hexamethylene diisocyanate; an aziridine based compound disclosed in the U.S. Pat. Nos. 3,017,280 and 2,983,611; a carboxy imide based compound disclosed in the U.S. Pat. No. 3,100,704; an epoxy based compound such as a glycerol triglycidyl ether; an ethylene imino based compound such as a 1,6-hexamethylene-N,N'-bisethylene urea; a halogenated carboxy aldehyde based compound such as a mucochloric acid and a mucophenoxy chloric acid; a dioxane based compound such as a 2,3-dihydroxy dioxane; a metal containing compound such as a titanium lactate, an aluminum sulfate, a titanium a chrome alum, a potash alum, a zirconium acetate and a chromium acetate, a polyamine compound such as a tetraethylene pentamine, a hydrazide compound such as a dihydrazide adipate, a low molecular compound containing two or more oxazoline group or a polymer, or the like can be presented.

The above-mentioned cross-linking agents may be used alone by one kind or in a combination of two or more kinds.

At the time of applying the above-mentioned cross-linking agent, the solution thereof can be prepared by dissolving a cross-linking agent in water and/or an organic solvent. The concentration of the cross-linking agent in the above-mentioned cross-linking agent solution is preferably 0.05 to 10% by mass with respect to the cross-linking agent solution, particularly preferably 0.1 to 7% by mass.

As the solvent for the cross-linking solution, in general, water is used, and a water based solvent mixture containing an organic solvent having a blending property with the water may be used.

As the above-mentioned organic solvent, one capable of dissolving the cross-linking agent can be used optionally. For example, an alcohol such as a methanol, an ethanol, an isopropyl alcohol, a polyethylene glycol and a glycerol; a ketone such as an acetone, and a methyl ethyl ketone; an ester such as a methyl acetate and an ethyl acetate; an aromatic solvent such as a toluene; an ether such as a tetrahydrofuran, and an amide based solvent such as a pyrrolidone, or the like can be presented.

The use amount of the cross-linking agent is preferably 1 to 50% by mass with respect to the water soluble resin, more preferably 5 to 40% by mass.

(Mordanting Agent)

In the invention, in order to further improve the water resistance of the formed image and the time passage blurring, it is preferable to include a mordanting agent in the color material accepting layer.

As the above-mentioned mordanting agent, a cationic polymer (cationic mordanting agent) or water soluble metal compound is preferable By providing the mordanting agent in the color material accepting layer, the water resistance and the time passage blurring can be improved by stabilizing the color material by the interaction with a liquid ink having an anionic dye as the color material.

For the mordanting agent, a method of adding the same to a coating solution containing the fine particles and the water soluble resin, or a method of preparing solutions independently and coating can be used in the case there is a risk of generation of aggregation with respect to the fine particles.

As the above-mentioned cationic mordanting agent, a polymer mordanting agent having a primary to tertiary amino group, or a quaternary ammonium base as the cationic group can be used preferably, but a cationic non-polymer mordanting agent can be used as well.

As the mordanting agent, a compound having a 500 to 100,000 weight average molecular weight are preferable from the viewpoint of improvement of the ink absorbing property of the color material accepting layer.

As the above-mentioned polymer mordanting agent, one obtained as a single polymer of a monomer having a primary to tertiary amino group and a salt thereof, or a quaternary ammonium base (mordanting monomer), or a copolymer or a condensation polymer of the mordanting monomer and another monomer (hereinafter referred to as the "non-mordanting monomer") is preferable. Moreover, these polymer mordanting agents can be used in a form of either a water soluble polymer or water dispersing latex particles.

As the above-mentioned monomer (mordanting monomer), for example, a trimethyl-p-vinyl benzyl ammonium chloride, a trimethyl-m-vinyl benzyl ammonium chloride, a triethyl-p-vinyl benzyl ammonium chloride, a triethyl-m-vinyl benzyl ammonium chloride, an N,N-dimethyl-N-ethyl-N-p-vinyl benzyl ammonium chloride, an N,N-diethyl-N-methyl-N-p-vinyl benzyl ammonium chloride, an N,N-dimethyl-N-n-propyl-N-p-vinyl benzyl ammonium chloride, an N,N-dimethyl-N-n-octyl-N-p-vinyl benzyl ammonium chloride, an N,N-dimethyl-N-benzyl-N-p-vinyl benzyl ammonium chloride, an N,N-diethyl-N-benzyl-N-p-vinyl benzyl ammonium chloride, an N,N-dimethyl-N-(4-methyl)benzyl -N-p-vinyl benzyl ammonium chloride, an N,N-dimethyl-N-phenyl-N-p-vinyl benzyl ammonium chloride;

a trimethyl-p-vinyl benzyl ammonium bromide, a trimethyl-m-vinyl benzyl ammonium bromide, a trimethyl-p-vinyl benzyl ammonium sulfonate, a trimethyl-m-vinyl benzyl ammonium sulfonate, a trimethyl-p-vinyl benzyl ammonium acetate, a trimethyl-m-vinyl benzyl ammonium acetate, an N,N,N-triethyl-N-2-(4-vinyl phenyl)ethyl ammonium chloride, an N,N,N-triethyl-N-2-(3-vinyl phenyl)ethyl ammonium chloride, an N,N-diethyl-N-methyl-N-2-(4-vinyl phenyl)ethyl ammonium chloride, an N,N-diethyl-N-methyl-N-2-(4-vinyl phenyl)ethyl ammonium acetate;

an N,N-dimethyl amino ethyl (meth)acrylate, an N,N-diethyl amino ethyl (meth)acrylate, an N,N-dimethyl amino propyl (meth)acrylate, an N,N-diethyl amino propyl (meth) acrylate, an N,N-dimethyl amino ethyl (meth)acrylic amide, an N,N-diethyl amino ethyl (meth)acrylic amide, an N,N-dimethyl amino propyl (meth)acrylic amide, a methyl chloride, an ethyl chloride, a methyl bromide, an ethyl bromide, a methyl iodide or a tertiary produce of an ethyl iodide of an N,N-diethyl amino propyl (meth)acrylic amide, or a sulfonate with the anion thereof substituted, an alkyl sulfonate, an acetate or an alkyl carboxylate, or the like can be presented.

Specifically, for example, a monomethyl diallyl ammonium chloride, a trimethyl-2-(methacryloyl oxy)ethyl ammonium chloride, a triethyl-2-(methacryloyl oxy)ethyl ammonium chloride, a trimethyl-2-(acryloyl oxy)ethyl ammonium chloride, a triethyl-2-(acryloyl oxy)ethyl ammonium chloride, a trimethyl-3-(methacryloyl oxy)propyl ammonium chloride, a triethyl-3-(methacryloyl oxy)propyl ammonium chloride, a trimethyl-2-(methacryloyl amino) ethyl ammonium chloride, a triethyl-2-(methacryloyl amino)ethyl ammonium chloride, a trimethyl-2-(acryloyl amino)ethyl ammonium chloride, a triethyl-2-(acryloyl amino) ethyl ammonium chloride, a trimethyl-3-(methacryloyl amino)propyl ammonium chloride, a triethyl-3-(methacryloyl amino)propyl ammonium chloride, a trimethyl-3-(acryloyl amino)propyl ammonium chloride, a triethyl-3-(acryloyl amino)propyl ammonium chloride;

an N,N-dimethyl-N-ethyl-2-(methacryloyl oxy)ethyl ammonium chloride, an N,N-diethyl-N-methyl-2-(methacryloyl oxy)ethyl ammonium chloride, an N,N-dimethyl-N-ethyl-3-(acryloyl amino)propyl ammonium chloride, a trimethyl-2-(methacryloyl oxy)ethyl ammonium bromide, a trimethyl-3-(acryloyl amino)propyl ammonium bromide, a trimethhyl-2-(methacryloyl oxy)ethyl ammonium sulfonate, a trimethyl-3-(acryloyl amino)propyl ammonium acetate, or the like can be presented.

In addition thereto, as a copolymerizable monomer, an N-vinyl imidazol, an N-vinyl-2-methyl imidazol, or the like can be presented as well.

Moreover, an allyl amine, a diallyl amine or a derivative thereof, a salt, or the like can be used as well. As the examples of these compounds, anallyl amine, an allyl amine hydrochloride, an allyl amine acetate, an allyl amine sulfate, a diallyl amine, a diallyl amine hydrochloride, a diallyl amine acetate, a diallyl amine sulfate, a diallyl methyl amine and a salt thereof (as the salt, for example, a hydrochloride, an acetate, a sulfate, or the like), a diallyl ethyl amine and a salt thereof (as the salt, for example, a hydrochloride, an acetate, a sulfate, or the like), and a diallyl dimethyl ammonium salt (as a pair anion of the salt, a chloride, an acetic acid ion, a sulfuric acid ion, or the like), can be presented. Since these allyl amine and diallyl amine derivatives are poor in terms of the polymerizability in the amine form, in general, they are polymerized in a salt form and as needed desalinated.

Moreover, a vinyl amine unit obtained by using an N-vinyl acetamide, an N-vinyl formamide, or the like as the unit, polymerization and hydrolysis, and a salt thereof can be used as well.

The above-mentioned non-mordanting agent denotes a monomer not including a basic or cationic part such as a primary to tertiary amino group and a salt thereof, or a quaternary ammonium base, or the like, not having interaction with a dye in an ink-jet ink, or having a substantially small interaction therewith.

As the above-mentioned non-mordanting monomer, for example, an alkyl ester (meth)acrylate; a cycloalkyl ester (meth)acrylate such as a cyclohexyl (meth)acrylate; an aryl ester (meth)acrylate such as a phenyl (meth)acrylate; an aralkyl ester such as a benzyl (meth)acrylate; aromatic vinyls such as a styrene, a vinyl toluene, and an $\alpha$-methyl styrene; vinyl esters such as a vinyl acetate, a vinyl propionate, and a vinyl barsatate; ally esters such as an allyl acetate; a halogen containing monomer such as a vinylidene chloride and a vinyl chloride; a cyanated vinyl such as a (meth)acryloyl nitrile; olefins such as an ethylene and a propylene, or the like can be presented.

As the above-mentioned alkyl ester (meth)acrylate, an alkyl ester (meth)acrylate having 1 to 18 carbon atoms in the alkyl part is preferable. For example, a methyl (meth) acrylate, an ethyl (meth)acrylate, a propyl (meth)acrylate, an isopropyl (meth)acrylate, an n-butyl (meth)acrylate, an isobutyl (meth)acrylate, a t-butyl (meth)acrylate, a hexyl (meth)acrylate, an octyl (meth)acrylate, a 2-ethyl hexyl (meth)acrylate, a lauryl (meth)acrylate, a stearyl (meth) acrylate, or the like can be presented.

In particular, a methyl acrylate, an ethyl acrylate, a methyl methacrylate, an ethyl methacrylate, and a hydroxyl ethyl methacrylate are preferable.

The above-mentioned non-mordanting monomers can be used alone by one kind or in a combination of two or more kinds.

Furthermore, as the polymer mordanting agent, cyclic amine resins and derivatives thereof (including copolymers) represented by a polydiallyl methyl ammonium chloride, a copolymer of a diallyl dimethyl ammonium chloride and another monomer (a mordanting monomer, a non-mordanting monomer), a copolymer of a diallyl dimethyl ammonium chloride and an $SO_2$, a polydiallyl methyl amine hydrochloride, a polydiallyl hydrochloride, or the like; secondary amino, tertiary amino or quaternary ammonium salt substituted alkyl (meth)acrylate polymers and copolymers with another monomer represented by a polydiethyl methacryloyloxy ethyl amine, a polytrimethyl methacryloyloxy ethyl ammonium chloride, a polydimethyl benzyl methacryloyloxy ethyl ammonium chloride, a polydimethyl hydroxy ethyl acryloyloxy ethyl ammonium chloride, or the like; polyamine based resins represented by a polyethylene imine and a derivative thereof, a polyallyl amine and a derivative thereof, a polyvinyl amine and a derivative thereof, or the like; polyamide resins represented by a polyamide-polyamine resin, a polyamide epichlorohydrin resin, or the like; polysaccharides represented by a cationated starch, a chitosan, a chitosan derivative, or the like; dicyan diamide derivatives represented by a dicyan diamide formalin polycondensation product, a dicyan diamide diethylene triamine polycondensation product, or the like; a polyamidine and a polyamidine derivative; dialkyl amine epichlorohydrin addition polymerization products and derivatives thereof represented by a dimethyl amine epichlorohydrin addition polymerization product, or the like; and styrene polymers having a quaternary ammonium salt substituted alkyl group and a copolymer with another monomer, or the like can be presented as well as preferable examples.

As the above-mentioned polymer mordanting agent, specifically, those disclosed in JP-A Nos. 48-28325, 54-74430, 54-124726, 55-22766, 55-142339, 60-23850, 60-23851, 60-23852, 60-23853, 60-57836, 60-60643, 60-118834, 60-122940, 60-122941, 60-122942, 60-235134, and 1-161236, the U.S. Pat. Nos. 2,484,430, 2,548,564, 3,148,061, 3,309,690, 4,115,124, 4,124,386, 4,193,800, 4,273,853, 4,282,305, and 4,450,224, JP-A Nos. 1-161236, 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777, and 2001-301314, or the like can be presented. Particularly, polyamine based compounds and derivatives thereof, such as a quaternary ammonium salt type polymer having an aromatic group in a partial structure, a (meth)acrylate based or (meth)acrylic amide based polymer having a tertiary amino group, a polyallyl amine and a derivative thereof are preferable.

As the organic mordanting agent of the invention, those having a 100,000 or less weight average molecular weight are preferable particularly from the viewpoint of prevention of time passage blurring.

Specifically, for example, a calcium acetate, a calcium chloride, a calcium formate, a calcium sulfate, a barium acetate, a barium sulfate, a barium phosphate, a manganese chloride, a manganese acetate, a manganese formate dihydrate, a manganese sulfate ammonium hexahydrate, a cupric chloride, an ammonium chloride copper (II) dihydrate, a copper sulfate, a cobalt chloride, a cobalt thiocyanate, a cobalt sulfate, a nickel sulfate hexahydrate, a nickel chloride hexahydrate, a nickel acetate tetrahydrate, a nickel sulfate ammonium hexahydrate, a nickel amidosulfate tetrahydrate, an ammonium sulfate, an aluminum alum, a basic aluminum polyhydroxide, an aluminum sulfite, an aluminum thiosulfate, an aluminum polychloride, an aluminum nitrate nonahydrate, an aluminum chloride hexahydrate, a ferrous bromide, a ferrous chloride, a ferric chloride, a ferrous sulfate, a ferric sulfate, a zinc phenosulfonate, a zinc bromides a zinc chloride, a zinc nitrate hexahydrate, a zinc sulfate, a titanium tetrachloride, a tetraisopropyl titanate, a titanium acetyl acetonate, a titanium lactate, a zirconium acetyl acetonate, a zirconyl acetate, a zirconyl sulfate, a zirconium carbonate ammonium, a zirconyl stearate, a zirconyl octate, a zirconyl nitrate, a zirconium oxychloride, a zirconium hydroxy chloride, a chromium acetate, a chromium sulfate, a magnesium sulfate, a magnesium chloride hexahydrate, a magnesium citrate nonahydrate, a sodium phosphotungstate, a sodium citrate tungsten, a 12 tungstophosphoric acid n hydrate, a 12 tungstosilic acid 26 hydrate, a molybdenum chloride, a 12 molybdophosphoric acid n hydrate, a gallium nitrate, a germanium nitrate, a strontium nitrate, a yttrium acetate, a yttrium chloride, a yttrium nitrate, an indium nitrate, a lanthanum nitrate, a lanthanum chloride, a lanthanum acetate, a lanthanum benzoate, a cerium chloride, a cerium sulfate, a cerium octate, a praseodymium nitrate, a neodymium nitrate, a samarium nitrate, a europium nitrate, a gadolinium nitrate, a dysprosium nitrate, an erbium nitrate, a ytterbium nitrate, a hafnium chloride, a bismuth nitrate, or the like can be presented.

As the inorganic mordanting agent of the invention, an aluminum containing compound, a titanium containing compound, a zirconium containing compound, and a metal compound of the element periodic table IIIB group series (salt or complex) are preferable.

The above-mentioned mordanting agent amount contained in the color material accepting layer of the invention is preferably 0.01 $g/m^2$ to 5 $g/m^2$, more preferably 0.1 $g/m^2$ to 3 $g/m^2$.

In the case a compound of the above-mentioned general formulae (I) to (IV) of the invention is contained in the color material accepting layer, it may be used in a form of a salt of an organic acid or an inorganic acid. The acid may be preliminarily mixed with the compound of the general formulae (I) to (IV), or it may be coated and mixed with a coating solution containing the general formulae (I) to (IV) simultaneously or consecutively.

According to the addition of the acid, the surface PH of the color material accepting layer is adjusted to 3 to 8, preferably 5 to 7.5. Thereby, since the yellowing resistance of the white base part can be improved, and thus it is preferable. The surface PH is measured by the A method (coating method) among the surface PH measurement methods specified by the Japan Paper Pulp Technology Association (J. TAPPI). For example, the measuring operation can be carried out using the paper surface PH measuring set "type MPC" produced by Kyoritsu Rikagaku Kenkyusho, Corp. corresponding to the above-mentioned A method.

As the specific examples of the acid, a formic acid, an acetic acid, a glycolic acid, an oxalic acid, a propionic acid, a malonic acid, a succinic acid, an adipic acid, a maleic acid, a malic acid, a tartaric acid, a citric acid, a benzoic acid, a phthalic acid, an isophthalic acid, a glutaric acid, a gluconic acid, a lactic acid, an aspartic acid, a glutamic acid, a salicylic acid metal salt (salts such as a Zn, an Al, a Ca, and an Mg), a methane sulfonic acid, an itaconic acid, a benzene sulfonic acid, a toluene sulfonic acid, a trifluoromethane sulfonic acid, a styrene sulfonic acid, a trifluoroacetic acid, a barbituric acid, an acrylic acid, a methacrylic acid, a cinnamic acid, a 4-hydroxy benzoic acid, an amino benzoic acid, a naphthalene disulfonic acid, a hydroxy benzene sulfonic acid, a toluene sulfinic acid, a benzene sulfinic acid, a sulfanilic acid, a sulfamic acid, an α-resorcylic acid, a β-resorcylic acid, a γ-resorcylic acid, a gallic acid, a fluoro glycine, a sulfosalicylic acid, an ascorbic acid, an erysorbic acid, a bisphenolic acid, a hydrochloric acid, a nitric acid, a sulfuric acid, a phosphoric acid, a polyphosphoric acid, a boric acid, a boron acid, or the like can be presented. The addition amount of these acids can be determined so as to have the surface PH of the color material accepting layer at 3 to 8.

The above-mentioned acids may be used in a form of a metal salt (for example, a salt of a sodium, a potassium, a calcium, a cesium, a zinc, a copper, an iron, an aluminum, a zirconium, a lanthanum, a yttrium, a magnesium, a strontium, a cerium, or the like), or an amine salt (for example, an ammonia, a triethyl amine, a tributyl amine, a piperadine, a 2-methyl piperadine, a polyallyl amine, or the like).

(Other Components)

An ink-jet recording sheet of the invention as needed may further include various kinds of known additives such as an ultraviolet ray absorbing agent, an antioxidant, a brightening agent, a monomer, a polymerization initiating agent, a polymerization inhibiting agent, a blurring preventing agent, an antiseptic agent, a viscosity stabilizing agent, an antifoaming agent, a surfactant, an antistatic agent, a matting agent, a curl preventing agent, a water resistance agent, or the like.

It is preferable that the compounds represented by the above-mentioned general formulae (I) to (IV) of the invention are used in a combination with a storage property improving agent such as an ultraviolet ray absorbing agent, an antioxidant, and a blurring preventing agent.

As the ultraviolet ray absorbing agent, the antioxidant and the blurring preventing agent usable in a combination, an alkylated phenol compound (including a hindered phenol compound), an alkyl thiomethyl phenol compound, a hydroquinone compound, an alkylated hydroquinone compound, a tocopherol compound, a thiodiphenyhl ether compound, a compound having two or more thioether bonds, a bisphenol compound, O—, N— and S-benzyl compounds, a hydroxy benzyl compound, a triazine compound, a phosphonate compound, an acyl amino phenol compound, an ester compound, an amide compound, an ascorbic acid, an amine based antioxidant, a 2-(2-hydroxy phenyl)benzotriazol compound, a 2-hydroxy benzophenone compound, an acrylate, a water soluble or hydrophobic metal salt, an organic metal compound, a metal complex, a hindered amine compound (including a TEMPO compound), a 2-(2-hydroxy phenyl)1,3,5,-triazine compound, a metal inactivating agent, a phosphite compound, a phosphonite compound, a hydroxy amine compound, a nitron compound, a peroxide scavenger, a polyamide stabilizing agent, a polyether compound, a basic auxiliary stabilizing agent, a core agent, a benzofuranone compound, an indolinone compound, a phosphine compound, a polyamine compound, a thiourea compound, a urea compound, a hydrazide compound, an amidine compound, a sugar compound, a hydroxy benzoic acid compound, a dihydroxy benzoic acid compound, a trihydroxy benzoic acid compound, or the like can be presented.

Among these examples, it is preferable to use in a combination of at least one kind selected from the group consisting of an alkylated phenol compound, a compound having two or more thioether bonds, a bisphenol compound, an ascorbic acid, an amine based antioxidant, a water soluble or hydrophobic metal salt, an organic metal compound, a metal complex, a hindered amine compound, a polyamine compound, a thiourea compound, a hydrazide compound, a hydroxy benzoic acid compound, a dihydroxy benzoic acid compound, and a trihydroxy benzoic acid compound.

As the specific examples of the compounds, those disclosed in JP-A Nos. 10-182621, and 2001-260519, the JP-B Nos. 4-23953, and 4-34513, the JP-A No. 11-170686, The Japanese Patent Application No. 2001-152237, the JP-B No. 4-34512, the EP No. 1,138,509, the JP-A Nos. 60-67190, 7-276808, 2001-94829, 47-10537, 58-111942, 58-212844, 59-19945, 59-46646, 59-109055, 63-53544, JP-B Nos. 36-10466, 42-26187, 48-30492, 48-31255, 48-41572, 48-54965, 50-10726, the specifications of the U.S. Pat. Nos. 2,719,086, 3,707,375, 3,754,919, 4,220,711;

the JP-B Nos. 45-4699, 54-5324, EU Publication Patent Nos. 223,739, 309,401, 309,402, 310,551, 310,552, 459, 416, German Publication Patent No. 3,435,443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, 63-113536;

63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437, 5-170361, JP-B Nos. 48-43295, 48-33212, U.S. Pat. Nos. 4,814,262, 4,980, 275, or the like can be presented.

The above-mentioned other components may be used alone by one kind or in a combination of two or more kinds. The above-mentioned other components may be added as a water soluble product, a dispersion, an emulsion, or oil drops, or it may be contained in a microcapsule. The addition amount of the above-mentioned other components is preferably 0.01 to 10 g/m$^2$ in an ink-jet recording sheet of the invention.

Moreover, in order to improve the dispersion property or the inorganic fine particles, the inorganic surface may be treated with a silane coupling agent. As the silane coupling agent, those having an organic functional group (such as a vinyl group, an amino group, an epoxy group, a mercapto group, a chloro group, an alkyl group, a phenyl group, and an ester group) in addition to a portion to have the coupling process are preferable.

In the invention, it is preferable that the color material accepting layer coating solution contains a surfactant. As the surfactant, any of cation based, anion based, nonion based, amphoteric, fluorine based, silicone based surfactants can be used.

As the above-mentioned nonion based surfactant, polyoxy alkylene alkyl ethers and polyoxy alkylene alkyl phenyl ethers (such as a diethylene glycol monoethyl ether, a diethylene glycol diethyl ether, a polyoxy ethylene lauryl ether, a polyoxy ethylene stearyl ether, and a polyoxy ethylene nonyl phenyl ether), an oxyethylene-oxypropylene block copolymer, sorbitan fatty acid esters (such as a sorbitan monolaurate, a sorbitan monooleate, and a sorbitan trioleate), polyoxy ethylene sorbitol fatty acid esters (such as a polyoxy ethylene sorbit tetraoleate), glycerol fatty acid esters (such as a glycerol monooleate), polyoxy ethylene glycerol fatty acid esters (such as a polyoxy ethylene glycerol monostearate, and a polyoxy ethylene glycerol monooleate), polyoxy ethylene fatty acid esters (such as a polyethylene glycol monolaurate, and a polyethylene glycol monooleate), a polyoxy ethylene alkyl amine, acetylene glycols (such as a 2,4,7,9-tetramethyl-5-decin-4,7-diol, and an ethylene oxide adduct of the diol, a propylene oxide adduct), or the like can be presented. Polyoxy alkylene alkyl ethers are preferable. The nonion based surfactants can be used in the first coating solution and the second coating solution. Moreover, the above-mentioned nonion based surfactants may be used alone by one kind or in a combination of two or more kinds.

As the above-mentioned amphoteric surfactant, those of the amino acid type, the carboxy ammonium betaine type, the sulfon ammonium betaine type, the ammonium sulfuric acid ester betaine type, the imidazolium betaine type, or the like can be presented. For example, those disclosed in the specification of the U.S. Pat. No. 3,843,368, JP-A Nos. 59-49535, 63-236546, 5-303205, 8-262742, 10-282619, or the like can be used preferably. As the amphoteric surfactant, the amino acid type amphoteric surfactant is preferable. As the amino acid type amphoteric surfactant, an N-amino acyl acid with a long chain acyl group introduced, as a derivative obtained from an amino acid (such as a glycine, a glutamic acid, and a histidine), and a salt thereof can be presented. The above-mentioned amphoteric surfactants may be used alone by one kind or in a combination of two or more kinds.

As the above-mentioned anionic surfactant, fatty acid salts (such as a sodium stearate and a potassium oleate, alkyl sulfates (such as a sodium lauryl sulfate and a triethanol amine lauryl sulfate), sulfonates (such as a sodium dodecyl benzene sulfonate), dialkyl sulfo succinic acid salts (such as a sodium dioctyl sulfo succinate), an alkyl diphenyl ether disulfonate, an alkyl phosphate, or the like can be presented.

As the above-mentioned cation based surfactant, an alkyl amine salt, a quaternary ammonium salt, a pyridinium salt, an imidazolium salt, or the like can be presented.

A the above-mentioned fluorine based surfactant, compounds derived from an intermediate having a perfluoro alkyl group by a method of electrolytic fluorination, telomerization, oligomerization, or the like can be presented.

For example, a perfluoro alkyl sulfonate, a perfluoro alkyl carboxylate, a perfluoro alkyl ethyl oxide adduct, a perfluoro alkyl trialkyl ammonium salt, a perfluoro alkyl group containing oligomer, a perfluoro alkyl phosphate, or the like can be presented.

As the above-mentioned silicone based surfactant, a silicone oil modified by an organic group is preferable. It can have a structure with a side chain of the siloxane structure modified by an organic group, a structure with the both ends modified, and a structure with one end modified. As the organic group modification, amino modification, polyether modification, epoxy modification, carboxyl modification, carbinol modification, alkyl modification, aralkyl modification, phenol modification, fluorine modification, or the like can be presented.

The content of the surfactant in the invention is preferably 0.001 to 2.0% with respect to the color material accepting layer coating solution, more preferably 0.01 to 1.0%. Moreover, in the case of coating with two or more solutions as the color material accepting layer coating solution, it is preferable to add a surfactant to each of the coating solutions.

(High Boiling Point Organic Solvent)

In the invention, it is preferable that the color material accepting layer contains a high boiling point organic solvent for curling prevention. The above-mentioned high boiling point organic solvent is an organic compound having a 150° C. or more boiling point at an ordinary pressure, and a water soluble or hydrophobic compound. These may be liquid or solid at a room temperature, and they may be a low molecular compound or a polymer compound.

Specifically, aromatic carboxylates (such as a dibutyl phthalate, a diphenyl phthalate and a phenyl benzoate), aliphatic carboxylates (such as a dioctyl adipate, a dibutyl sebacate, a methyl stearate, a dibutyl maleate, a dibutyl fumarate, and a triethyl acetyl citrate), phosphates (such as a trioctyl phosphate and a tricredyl phosphate), epoxys (such as an epoxidated soy bean oil and an epoxidated aliphatic methyl), alcohols (such as a stearyl alcohol, an ethylene glycol, a propylene glycol, a diethylene glycol, a triethylene glycol, a glycerol, a diethylene glycol monobutyl ether (DEGMBE), a triethylene glycol monobutyl ether, a glycerol monomethyl ether, a 1,2,3-butane triol, a 1,2,4-butane triol, a 1,2,4-pentane triol, a 1,2,6-hexane triol, a thiodiglycol, a triethanol amine and a polyethylene glycol), plant oils (such as a soy bean oil and a sunflower oil), higher aliphatic carboxylic acids (such as a linoleic acid and an oleic acid), or the like can be presented.

(Substrate)

As the substrate of the invention, either of a transparent substrate comprising a transparent material such as a plastic, or a non-transparent substrate comprising a non-transparent material such as a paper can be used. For taking advantage of the transparency of the color material accepting layer, it is preferable to use a transparent substrate or a highly glossy non-transparent substrate.

As a material usable for the above-mentioned transparent substrate, a transparent material having the nature durable to the radiation heat at the time of use for an OHP or a backlight display is preferable. As the material, for example, polyesters such as a polyethylene terephthalate (PET); a polysulfone, a polyphenylene oxide, a polyimide, a polycarbonate, a polyamide, or the like can be presented. Among these examples, polyesters are preferable, and a polyethylene terephthalate is particularly preferable.

The thickness of the above-mentioned transparent substrate is not particularly limited, and it is preferable 50 to 200 μm in terms of the handling property.

As the highly glossy non-transparent substrate, those having a 40% or more glossiness in the surface on the side provided with the color material accepting layer are preferable. The glossiness is a value obtained according to the method disclosed in the JIS P-8142 (75 degree mirror surface glossiness testing method for the paper and the cardboard). Specifically, the following substrates can be presented.

For example, highly glossy paper substrates such as an art paper, a coat paper, a cast coat paper, and a baryta paper used as a substrate for the silver salt photography; highly glossy films provided by containing a white pigment or the like in a plastic film so as to be non-transparent (a surface calendar process may be applied) such as polyesters such as a polyethylene terephthalate (PET), cellulose polyesters such as a nitro cellulose, a cellulose acetate, and a cellulose acetate butylate, a polysulfone, a polyphenylene oxide, a polyimide, a polycarbonate and a polyamide; and a substrate with a cover layer of a polyolefin containing or not containing a white pigment provided on the surface of the above-mentioned various kinds of the paper substrates, the above-mentioned transparent substrates or the highly glossy films containing a white pigment, or the like, can be presented.

A white pigment containing foamed polyester film (such as a foamed PET with a gap formed by containing polyolefin fine particles and drawing) can be presented preferably. Furthermore, a resin coating paper used for the silver salt photographic printing paper is also preferable.

The thickness of the above-mentioned non-transparent substrate is not particularly limited, and it is preferably 50 to 300 μm in terms of the handling property.

Moreover, in order to improve the wetting characteristic and the bonding property, substrates having a corona discharge process, a glow discharge process, a flame process, an ultraviolet ray irradiation process, or the like applied on the surface may be used.

Next, the base paper used for the above-mentioned resin coating paper will be described in detail.

The above-mentioned base paper is produced using a wood pulp as the main material, and as needed using a synthetic pulp such as a polypropylene or a synthetic fiber such as a nylon and a polyester in addition to the wood pulp. As the above-mentioned wood pulp, any lf an LBKP, an LBSP, an NBKP, an NBSP, an LDP, an NDP, an LUKP, and an NUKP can be used, and it is preferable to use an LBKP, an NBSP, an LBSP, an NDP, and an LDP, which have a large amount of short fibers by a larger amount.

However, the ratio of the LBSP and/or LDP is preferably 10% by mass or more, and 70% by mass or less.

As the above-mentioned pulp, a chemical pulse (a sulfate pulp and a sulfite pulp) with little impurity can be used preferably, and a pulp with the whiteness improved by executing a bleaching process is also useful.

In the base paper, a sizing agent such as a higher fatty acid and an alkyl ketene dimmer, a white pigment such as a calcium carbonate, a talc and a titanium oxide, a paper power intensifying agent such as a starch, a polyacrylic amide, and a polyvinyl alcohol, a brightening agent, a water content retaining agent such as polyethylene glycols, a dispersing agent, a softening agent such as a quaternary ammonium can be added optionally.

The freeness of the pulp used for the paper production is preferably 200 to 500 ml by the CSF standard. Moreover, as to the fiber length after beating, the sum of the 24 mesh residual component mass % and the 42 mesh residual component mass % specified in the JIS P-8207 is preferably 30 to 70%. The mass % of the 4 mesh residual component is preferably 20% by mass or less.

The basis weight of the base paper is preferably 30 to 250 g, and particularly preferably 50 to 200 g. The thickness of the base paper is preferably 40 to 250 μm. The base paper can be provided with a high smoothness by the calendar process in the paper production step or after the paper production. The base paper density is in general 0.7 to 1.2 $g/m^2$ (JIS P-8118).

Furthermore, the base paper rigidity is preferably 20 to 200 g in the condition specified in the JIS P-8143.

A surface sizing agent may be applied on the base paper surface. As the surface sizing agent, the same sizing agents as the above-mentioned sizing agents added to the base paper can be used.

The pH of the base paper is preferably 5 to 9 in the case of measurement by the hot water extracting method specified in the JIS P-8113.

The polyethylene for covering the front surface and the back surface of the base paper is mainly a low density polyethylene (LDPE) and/or a high density polyethylene (HDPE). A part of the other LLDPE, polypropylenes, or the like can be used as well.

As the polyethylene layer on the side for forming the color material accepting layer is preferably one produced by adding a rutile or anatase type titanium oxide, a brightening agent, and an ultramarine in a polyethylene so as to improve the opaqueness, the whiteness and the hue as widely executed for the photographic printing paper. Here, the titanium oxide content is preferably about 3 to 20% by mass with respect to the polyethylene, and more preferably 4 to 13% by mass. Although the thickness of the polyethylene layer is not particularly limited, it is preferably 10 to 50 μm for both the front and back surface layers. Furthermore, a base coating layer can be provided on the polyethylene layer for providing the close contact property with respect to the color material accepting layer. As the base coating layer, a water base polyester, a gelatin, and a PVA are preferable. Moreover, the thickness of the base coating layer is preferably 0.01 to 5 μm.

As the polyethylene covering paper, a glossy paper, or one having a mat surface or a silk-like texture surface formed for an ordinary photographic printing paper by executing the so-called stamping process at the time of molten extrusion of the polyethylene onto the base paper surface for coating can be used.

A back coating layer may be provided in the substrate. As the component to be added in the back coating layer, a white pigment, a water base binder, and other components can be presented.

As the white pigment contained in the back coating layer, for example, white inorganic pigments such as a light calcium carbonate, a heavy calcium carbonate, a kaolin, a talc, a calcium sulfate, a barium sulfate, a titanium dioxide, a zinc oxide, a zinc sulfate, a zinc carbonate, a satin white, an aluminum silicate, a diatomaceous earth, a calcium silicate, a magnesium silicate, a synthetic amorphous silica, a colloidal silica, a colloidal alumina, a quasi boehmite, an aluminum hydroxide, an alumina, a lithopone, a zeolite, a hydrated halloysite, a magnesium carbonate and a magnesium hydroxide, organic pigments such as a styrene based plastic pigment, an acrylic based plastic pigment, a polyethylene, a microcapsule, a urea resin and a melamine resin, or the like can be presented.

As the water base binder used for the back coating layer, for example, water soluble polymers such as a styrene/maleate copolymer, a styrene/acrylate copolymer, a polyvinyl alcohol, a silanol modified polyvinyl alcohol, a starch, a cationated starch, a casein, a gelatin, a carboxy methyl cellulose, a hydroxy ethyl cellulose and a polyvinyl pyrrolidone, water dispersible polymers such as a styrene butadiene latex and an acrylic emulsion, or the like can be presented.

As the other components contained in the back coating layer, an antifoaming agent, a foam inhibitor, a dye, a brightening agent, an antiseptic agent, a water resistance agent, or the like can be presented.

(Production of the Ink-jet Recording Sheet)

It is preferable that a color material accepting layer of the ink-jet recording sheet of the invention is formed by for example by a method of coating a first coating solution (hereinafter, it may be referred to also as the "coating solution (A)") containing at least the fine particles and the water soluble resin on the substrate surface, applying a second coating solution (hereinafter, it may be referred to also as the "coating solution (B)") containing at least the mordanting agent (1) simultaneously with the coating operation, (2) during the drying operation for the coating layer formed by the coating operation and before showing the decreasing rate of drying in the coating layer, or (3) after drying the first coating solution so as to form the coating film, and cross-linking and hardening the coating layer with the second coating solution applied (wet on wet method). Here, it is preferable that at least one kind of the compounds represented by the general formulae (I) to (IV) is contained in at least one of the above-mentioned first coating solution or second coating solution. Moreover, it is also preferable that the above-mentioned cross-linking agent cross-linkable the above-mentioned water soluble resin is contained in at least one of the above-mentioned first coating solution or second coating solution.

It is preferable to provide the color material accepting layer cross-linked and hardened as mentioned above in terms of the ink absorbing property and cracking prevention for the film.

Moreover, a color material accepting layer for the ink-jet recording sheet of the invention can be obtained also by a method of simultaneously coating on the substrate a first coating solution (A solution) containing fine particles and a water soluble resin, and a second coating solution (B solution) containing a mordanting agent in a state with a barrier solution of a component not reactive with the cross-linking agent (however, the mordanting agent is contained in at least one of the solution containing the cross-linking agent, or the barrier solution) interposed therebetween, drying and hardening.

According to the above-mentioned method, since much of the mordanting agent exists in the vicinity of the surface of the color material accepting layer, the ink-jet color material can sufficiently be mordanted so as to improve the water resistance of the characters and images after printing, and thus it is preferable. A part of the mordanting agent may be contained in the above-mentioned coating solution (A). In this case, the mordanting agents for the first coating solution (A) and the coating solution (B) may be the same one.

In the invention, the coating solution for a color material accepting layer containing at least fine particles (such as the gas phase method silica) and a water soluble resin (such as a polyvinyl alcohol) can be prepared for example as mentioned below, That is, it can be prepared by adding the gas phase method silica fine particles and the dispersing agent in water (for example, by 10 to 20% by mass of the silica fine particles in water), dispersing for 20 minutes (preferably 10 to 30 minutes) under a 10,000 rpm (preferably 5,000 to 20,000 rpm) high speed rotation condition using a high speed rotation wet type colloid mill (such as "KUREA MIX" produced by M Technique Co., Ltd.), adding a polyvinyl alcohol (PVA) aqueous solution (for example, with a PVA by about ⅓ mass of that of the above-mentioned gas phase method silica), further adding the compound in the case a compound of the general formula (I) to (IV) of the invention is contained in the coating solution for a color material accepting layer, and dispersing with the above-mentioned rotation condition. The obtained coating solution is a homogeneous sol, and by coating and drying the same on a substrate by the following coating method, a porous color material accepting layer having a three-dimensional mesh structure can be formed.

As the above-mentioned dispersion processing method, various kinds of conventionally known dispersing machines such as a high speed rotation dispersing machine, a medium agitating type dispersing machine (a ball mill, a sand mill, or the like), an ultrasonic dispersing machine, a colloid mill dispersing machine, and a high pressure dispersing machine can be used. In the invention, a colloid mill dispersing machine or a high pressure dispersing machine can be used preferably from the viewpoint that they can efficiently disperse formed lump-like fine particles.

Moreover, as the above-mentioned dispersing agent, a cationic polymer can be used. As the cationic polymer, the examples provided for the above-mentioned mordanting agent can be presented.

To the above-mentioned coating solution for a color material accepting layer, as needed, a surfactant, a pH adjusting agent, a charge preventing agent, or the like may further be added.

The coating operation of the above-mentioned coating solution for a color material accepting layer can be executed by a known coating method such as an extrusion die coater, an air doctor coater, a bread coater, a rod coater, a knife coater, squeeze coater, a reverse roll coater and a bar coater.

The coating solution (B) is applied on the coating layer simultaneously with or after the coating operation of the coating solution for a color material accepting layer. The coating solution (B) may also be applied before the coating layer after the coating operation shows the decreasing rate of drying. That is, it can be produced preferably by introducing the mordanting agent before the coating layer shows the decreasing rate of drying after the coating operation of the coating solution for a color material accepting layer.

Here, "before showing the decreasing rate of drying in the coating layer" mentioned above in general denotes a process of several minutes from immediately after application of the coating solution for a color material accepting layer. During the time, the "constant rate of drying" as the phenomenon of having the solvent (dispersion medium) content in the coated coating layer reduced proportionally with the time is observed. The time showing the "constant rate of drying" is disclosed in Chemical Engineering Handbook (p. 707 to 712, published by Maruzen Corp., Oct. 25, 1980).

As mentioned above, the coating layer is dried after coating the first coating solution until the decreasing rate of drying is observed. The drying operation is executed in general at 50 to 180° C. for 0.5 to 10 minutes (preferably 0.5 to 5 minutes). Although the drying time naturally depends on the coating amount, in general, the above-mentioned range is appropriate.

As an application method before the first coating layer shows the decreasing rate of drying, a (1) method of further coating the coating solution (B) on the coating layer, a (2) spray method by a spray, or the like, a (3) method of soaking the substrate with the coating layer formed in the coating solution (B), or the like can be presented.

As a coating method for coating the coating solution (B) in the above-mentioned method (1), for example, a known coating method such as a curtain flow coater, an extrusion die coater, an air doctor coater, a bread coater, a rod coater, a knife coater, a squeeze coater, a reverse roll coater, and a bar coater can be used. However, it is preferable to use a method without direct contact of the coater with the first coating layer already formed, such as an extrusion die coater, a curtain flow coater and a bar coater.

After application of the mordanting agent solution, in general, a heating operation is executed at 40 to 180° C. for 0.5 to 30 minutes for drying and hardening. In particular, it is preferable to heat at 40 to 150° C. for 1 to 20 minutes.

Moreover, in the case the above-mentioned mordanting agent solution is applied simultaneously with the coating operation of the coating solution for a color material accepting layer, the color material accepting layer can be formed by simultaneous coating (superimposed layer coating) of the coating solution for a color material accepting layer and a mordanting agent solution on the substrate such that the coating solution for a color material accepting layer is contacted with the substrate, drying and hardening.

The above-mentioned simultaneous coating operation (superimposed layer coating) can be executed by a coating method using for example, an extrusion die coater and a curtain flow coater. The formed coating layer is dried after the simultaneous coating operation. The drying operation in this case in general is executed by heating the coating layer at 40 to 150° C. for 0.5 lo 50 minutes, preferably by heating at 40 to 100° C. for 0.5 to 5 minutes.

In the case the above-mentioned simultaneous coating (superimposed layer coating) is executed by for example, an extrusion die coater, the two kinds of the coating solutions ejected simultaneously are superimposed and formed in the vicinity of the ejection opening of the extrusion die coater, that is, before moving onto the substrate so as to be superimposed and coated onto the substrate in that state. Since the two layer coating solutions superimposed before coating can easily generate the cross-linking reaction already at the interface of the two solutions at the time of moving onto the substrate, the two solutions to be ejected are mixed in the vicinity of the ejection opening of the extrusion die coater so as to easily cause thickening, and thus there is a risk of causing troubles in the coating operation. Therefore, in the case of the simultaneous coating as mentioned above, it is preferable to dispose the barrier layer solution (intermediate layer solution) between the above-mentioned two solutions together with the coating solution for a color material accepting layer and the mordanting agent solution so as to execute the simultaneous three layer coating.

The above-mentioned barrier layer solution can be selected without any particular limit. For example, an aqueous solution containing a slight amount of a water soluble resin, water, or the like can be presented. The above-mentioned water soluble resin is to be used in consideration of the coating property as a thickening agent, or the like. For example, polymers such as a hydroxy propyl methyl cellulose, a methyl cellulose, a hydroxy ethyl methyl cellulose, a polyvinyl pyrrolidone, and a gelatin can be presented. In the barrier layer solution, the above-mentioned mordanting agent can be included.

Moreover, the color material accepting layer of the invention may be formed by a method of coating on the substrate surface a coating solution (C) obtained by adding a solution containing at least the above-mentioned polyvinyl alcohol (first solution) in an aqueous dispersion containing the above-mentioned gas phase method silica and dispersing agent so as to be re-dispersed, and applying on the above-mentioned coating layer a solution (D) containing at least the above-mentioned mordanting agent simultaneously with the coating operation, or during the drying operation of the coating layer formed by the coating operation and before the coating layer shows the decreasing rate of drying. At the time, the compounds of the general formulae (I) to (IV) of the invention may be added either of the above-mentioned coating solution (C) or the above-mentioned coating solution (D), or in both of them. According to the method, the glossiness degree and the printing density are improved, and thus it is preferable. It is also preferable that the cross-linking agent cross-linkable the water soluble resin is contained at least in either of the above-mentioned coating solutions (C) and (D).

As the above-mentioned dispersing agent, a cationic polymer can be used. As the cationic polymer, a single polymer of a monomer having a primary to tertiary amino group and a salt thereof, or a quaternary ammonium base, or a copolymer or a condensation polymer of the monomer and another monomer can be used preferably. Moreover, it is preferable to use these dispersing agents in a form of a water soluble polymer. Furthermore, it is also preferable to use a silane coupling agent as the dispersing agent.

The molecular weight of the above-mentioned dispersing agent is preferably 1,000 to 200,000 in the weight average molecular weight, more preferably 3,000 to 60,000. The addition amount of the above-mentioned dispersing agent with respect to the gas phase method silica is preferably 0.1% to 30%, more preferably 1% to 10%.

Moreover, for the preparation of the above-mentioned water dispersing agent containing the gas phase method silica and the dispersing agent, it is possible to prepare an aqueous dispersion in advance and add the aqueous dispersion to a dispersion aqueous solution, add a dispersion aqueous solution to a gas phase method silica aqueous dispersion, or mix simultaneously. Furthermore, with a powdery gas phase method silica used instead of the gas phase method silica aqueous dispersion, it can be added to the dispersion aqueous solution as mentioned above.

By fining the solution mixture using a dispersing machine after mixing the above-mentioned gas phase method silica and dispersing agent, an aqueous dispersion having a 50 to 300 nm average particle size can be obtained. As a dispersing machine used for obtaining the aqueous dispersion, various kinds of conventionally known dispersing machines such as a high speed rotation dispersing machine, a medium agitating type dispersing machine (a ball mill, a sand mill, or the like), an ultrasonic dispersing machine, a colloid mill dispersing machine, and a high pressure dispersing machine can be used. A colloid mill dispersing machine or a high pressure dispersing machine is preferable from the viewpoint that they can efficiently disperse formed lump-like fine particles.

Moreover, water, an organic solvent, or a solvent mixture thereof can be used as the solvent in each step. As an organic solvent used for the coating operation, alcohols such as a methanol, an ethanol, an n-propanol, an i-propanol, and a methoxy propanol, ketones such as an acetone, and a methyl ethyl ketone, a tetrahydro furan, an acetonitrile, an ethyl acetate, a toluene, or the like can be presented.

After the formation of the color material accepting layer on the substrate, the surface smoothness, the glossiness degree, the transparency and the coating film strength of the color material accepting layer can be improved by applying a calendar process by for example, using a super calendar, a gloss calendar, or the like and passing through between a roll nip under heating and pressuring. However, since the calendar process may provide a factor of deteriorating the void ratio (that is, the ink absorbing property may be lowered), it should be executed with a condition with a little void ratio deterioration set.

The roll temperature in the case of executing the calendar process is preferably 30 to 150° C., more preferably 40 to 100° C. Moreover, the linear load between the rolls at the time of the calendar process is preferably 50 to 400 kg/cm, more preferably 100 to 200 kg/cm.

Since the absorbing capacity capable of absorbing all the liquid droplets should be provided in the case of ink-jet recording, the layer thickness of the above-mentioned color material accepting layer should be determined in relation to the void ratio in the layer. For example, in the case of a 8 $nL/mm^2$ ink amount and a 60% void ratio, about a 15 μm or more layer thickness film is needed.

In consideration of this point, in the car of ink-jet recording, the layer thickness of the color material accepting layer is preferably 10 to 50 μm.

Moreover, the pore size of the color material accepting layer is preferably 0.005 to 0.030 μm by the median size, more preferably 0.01 to 0.025 μm.

The above-mentioned void ratio and pore median size can be measured with a mercury porosimeter (product name: "Bore Sizer 9320-PC2", produced by Shimadzu Corporation).

Furthermore, it is preferable that the color material accepting layer has the excellent transparency. As the scale therefor, the haze value of the color material accepting layer formed on the transparent film substrate is preferably 30% or less, more preferably 20% or less.

The above-mentioned haze value can be measured with a haze meter (HGM-2DP: produced by Suga Test Instrument Co. Ltd.).

A polymer fine particle dispersion may be added to a layer comprising the ink-jet recording sheet of the invention (such as the color material accepting layer and the back layer). The polymer fine particle dispersion layer is used for improving the film physical properties such as the size stabilization, the curling prevention, the bonding prevention and the film cracking prevention. The polymer fine particle dispersion is disclosed in JP-A Nos. 62-245258, 62-1316648 and 62-110066. Moreover, cracking or curling of the layer can be prevented by adding a polymer fine particle dispersion having a low glass transition temperature (40° C. or lower) to the layer containing the above-mentioned mordanting agent. Furthermore, curling can be prevented also by adding a polymer fine particle dispersion having a high glass transition temperature to the back layer.

Moreover, the ink-jet recording sheet of the invention can be produced also by the methods disclosed in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091 and 8-2093.

EXAMPLES

Hereinafter, the invention will be explained specifically with reference to examples, but the present invention is not limited to the examples. The "part" and "%" in the examples denote the "part by mass" and "% by mass" unless otherwise specified. The "average molecular weight" and the "polymerization degree" denote the "mass average molecular weight" and the "mass average polymerization degree".

(Production of the Substrate)

A 170 $g/m^2$ base paper was produced by beating a wood pulp comprising 100 parts of an LBKP to the 300 ml Canadian freeness by a double disc refiner, adding 0.5 part of an epoxylated amide behenate, 1.0 part of an anion polyacrylic amide, 0.1 part of a polyamide polyamine epichlorohydrin, and 0.5 part of a cation polyacrylic amide each by the absolute dry mass ratio with respect to the pulp, and weighing by a Fourdrinier paper machine.

In order to adjust the surface size of the above-mentioned base paper, a base paper with the density adjusted to 1.05 g/cc was obtained by impregnating the above-mentioned base paper in a 4% aqueous solution of a polyvinyl alcohol with 0.04% of a brightening agent ("Whitex BB" produced by Sumitomo Chemical Co., Ltd.) so as to become 0.5 $g/m^2$ based on the absolute dry mass, drying and further applying the calendar process.

A resin layer comprising a mat surface was formed (hereinafter the resin layer surface will be referred to as the "rear surface") by applying a corona discharge process to the wire surface (rear surface) side of the obtained base paper, and coating a high density polyethylene by a 19 μm thickness using a molten extruder. After further applying a corona discharge process on the rear side resin layer, a dispersion produced by dispersing an aluminum oxide (Alumina sol 100, produced by Nissan Chemical Industries, Ltd.) and a silicon dioxide (Snow Tex O, produced by Nissan Chemical Industries, Ltd.) in water by a 1:2 mass ratio was coated as the charge preventing agent so as to have a 0.2 g/m$^2$ dry mass.

Furthermore, after applying a corona discharge process on the felt surface (front surface) side without the resin layer, a highly glossy thermoplastic resin layer was formed on the front surface side of the base paper (hereinafter, the highly glossy surface will be referred to as the "front surface") so as to provide a substrate by extrusion of a low density polyethylene of a 3.8 MFR (melt flow rate) containing 10% of an anatase type titanium dioxide, a slight amount of an ultramarine, and 0.01% (with respect to the polyethylene) of a brightening agent by a 29 μm thickness using a molten extruder.

Example 1

Preparation of the Coating Solution A for a Color Material Accepting Layer

A coating solution A for a color material accepting layer was prepared by mixing (1) gas phase method silica fine particles, a (2) ion exchange water, and the (3) "PAS-M-1", dispersing for 20 minutes under a 10,000 rpm rotational frequency using a high speed rotation wet type colloid mill ("KUREA MIX" produced by M Technique Co., Ltd.), adding a solution containing a (4) polyvinyl alcohol, a (5) boric acid, a (6) polyoxy ethylene lauryl ether, and an (7) ion exchange water, and dispersing again for 20 minutes under a 10,000 rpm rotational frequency.

The mass ratio of the silica fine particles and the water soluble resin (PB ratio/(1):(4)) was 4.5:1, and the coating solution A for a color material accepting layer showed a 3.5 acidic value.

<Composition of the Coating Solution A for a Color Material Accepting Layer>

| | | |
|---|---|---|
| (1) | Gas phase silica fine particles (inorganic pigment fine particles) ("Leo Seal QS30" produced by Tokuyama Corp., average primary particle size 7 nm) | 10 parts |
| (2) | Ion exchange water | 51.7 parts |
| (3) | "PAS-M-1" (60% aqueous solution) (dispersing agent, produced by Nittobo) | 0.83 parts |
| (4) | Polyvinyl alcohol (water soluble resin) 8% aqueous solution ("PVA124", produced by Kuraray Co., Ltd., saponification degree 98.5%, polymerization degree 2,400) | 27.8 parts |
| (5) | Boric acid (cross-linking agent) | 0.4 parts |
| (6) | Polyoxy ethylene lauryl ether (surfactant) ("Emargen 109P", produced by Kao Corporation (10% aqueous solution), HLB value 13.6) | 1.2 parts |
| (7) | Ion exchange water (Production of the ink-jet recording sheet) | 33.0 parts |

After applying the corona discharge process on the front surface of the above-mentioned substrate, the coating solution A for a color material accepting layer obtained as mentioned above was coated on the front surface of the substrate by a 200 ml/m$^2$ coating amount using an extrusion die coater (coating step), and it was dried until the coating layer solid component density became 20% by a hot air drier at 80° C. (wind velocity 3 to 8 m/sec). The coating layer showed the constant rate of drying in the duration. Immediately thereafter, according to an operation of soaking in the mordanting agent solution B of the following composition for 30 seconds, it was adhered on the coating layer by 20 g/m$^2$ (step of applying the mordanting agent solution), and dried at 80° C. further for 10 minutes (drying step). Thereby, an ink-jet recording sheet (1) of the invention provided with a color material accepting layer by a 32 μm dry film thickness was provided.

<Composition of the mordanting solution B>

| | | |
|---|---|---|
| (1) | Boric acid (cross-linking agent) | 0.65 parts |
| (2) | Polyallyl amine "PAA-10C" 10% aqueous solution (mordanting agent, produced by Nittobo) | 25 parts |
| (3) | Below-mentioned compound (a) (compound of the invention) | 2.5 parts |
| (4) | Ion exchange water | 59.7 parts |
| (5) | Ammonium chloride (surface pH adjusting agent) | 0.8 parts |
| (6) | Polyoxy ethylene lauryl ether (surfactant) ("Emargen 109P" produced by Kao Corporation, 2% aqueous solution, HLB value 13.6) | 10 parts |
| (7) | Mega Fac "F1405" 10% aqueous solution (fluorine based surfactant produced by Dainippon Ink and chemicals, Incorporated) [Examples 2 to 26] | 2.0 parts |

Ink-jet recording sheets (2 to 26) of the invention were produced in the same manner as in the example 1 except that the compound (a) was changed to each of the following compounds (b) to (z) in the <composition of the mordanting agent solution B> in the example 1.

(a)

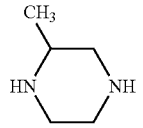

(b)

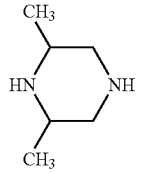

(c)

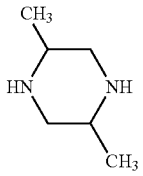

(d)

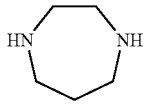

(e)

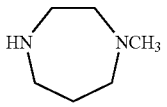

(f)

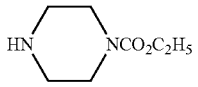

-continued (g)

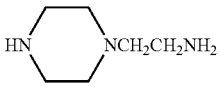

(h)

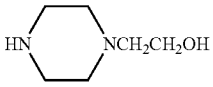

(i)

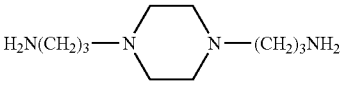

(j)

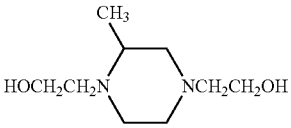

(k)

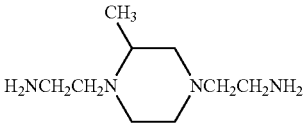

(l)

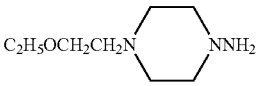

(m)

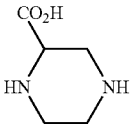

(n)

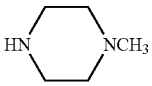

(o)

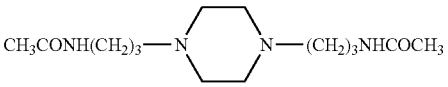

(p)

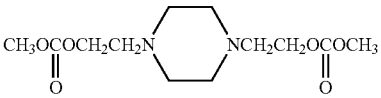

(q)

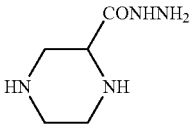

(r)

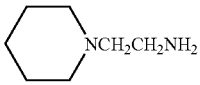

(s)

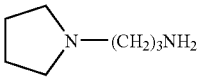

(t)

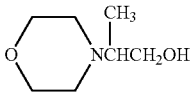

-continued (u)

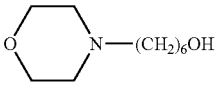

(v)

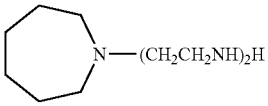

(w)

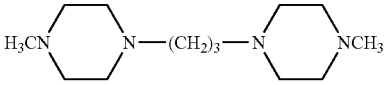

(x)

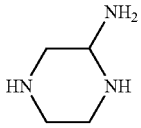

(y)

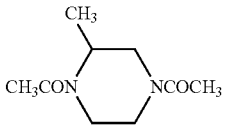

(z)

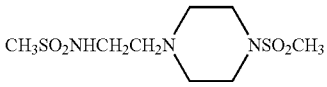

Example 27

An ink-jet recording sheet (27) of the invention was produced in the same manner as in the example 1 except that 0.4 part of the following light stability improving agent (1) was further added in the <composition of the mordanting agent solution B> in the example 1.

Example 28

An ink-jet recording sheet (28) of the invention was produced in the same manner as in the example 1 except that 1.0 part of the following light stability improving agent (2) was further added in the <composition of the mordanting agent solution B> in the example 1.

Example 29

An ink-jet recording sheet (29) of the invention was produced in the same manner as in the example 1 except that 0.7 part of the following light stability improving agent (3) was further added in the <composition of the mordanting agent solution B> in the example 1.

Light Stability Improving Agent (1)

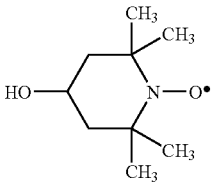

-continued (2)

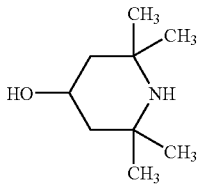

(3)

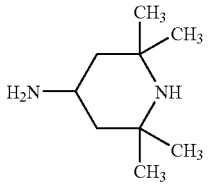

Example 30

An ink-jet recording sheet (30) of the invention was produced in the-same manner as in the example 1 except that the addition amount of the compound (a) was changed from 2.5 parts to 4.0 parts, and 3.0 parts of a toluene sulfonic acid was further added in the <composition of the mordanting agent solution B> in the example 1.

Example 31

An ink-jet recording sheet (31) of the invention was produced in the same manner as in the example 1 except that the addition amount of the compound (a) was changed from 2.5 parts to 1.5 parts, and 0.4 part of the above-mentioned light stability improving agent (1) and 1.5 parts of a guanyl thiourea were further added in the <composition of the mordanting agent solution B> in the example 1.

Example 32

An ink-jet recording sheet (32) of the invention was produced in the same manner as in the example 1 except that 0.83 part of "PAS-M-1" was changed to 0.6 part of a dimethyl diallyl ammonium chloride ("Sharol DC-902" produced by Dai-ichi Kogyo Seiyaku Co., Ltd., 50% aqueous solution) in the <composition of the coating solution A for a color material accepting layer> in the example 1.

Example 33

An ink-jet recording sheet (33) of the invention was produced in the same manner as in the example 1 except that 0.63 part of a basic aluminum chloride ($Al_2(OH)5Cl$, "PAC #1000" produced by Taki Chemical Co., Ltd., 40% aqueous solution) was further added in the <composition of the coating solution A for a color material accepting layer> in the example 1.

Example 34

An ink-jet recording sheet (34) of the invention was produced in the same manner as in the example 1 except that 0.6 part of a zirconyl acetate (30% aqueous solution) was further added in the <composition of the coating solution A for a color material accepting layer> in the example 1.

Example 35

An ink-jet recording sheet (35) of the invention was produced in the same manner as in the example 1 except that 0.2 part of a lanthanum nitrate was further added in the <composition of the coating solution A for a color material accepting layer> in the example 1.

Example 36

An ink-jet recording sheet (36) of the invention was produced in the same manner as in the example 1 except that 0.1% of the above-mentioned compound (a) was was further added in the <composition of the coating solution A for a color material accepting layer> in the example 1.

Comparative Example 1

An ink-jet recording sheet of a comparative example (1) was produced in the same manner as in the example 1 except that 2.5 parts of the compound (a) was not used in the <composition of the mordanting agent solution B> in the example 1.

Comparative Example 2

An ink-jet recording sheet of a comparative example (2) was produced in the same manner as in the example 1 except that 2.5 parts of an $HOCH_2CH_2SCH_2CH_2SCH_2CH_2OH$ was used instead of 2.5 parts of the compound (a) was not used in the <composition of the mordanting agent solution B> in the example 1.

Comparative Example 3

An ink-jet recording sheet of a comparative example (3) was produced in the same manner as in the example 1 except that 2.5 parts of an N-methyl thiourea was used instead of 2.5 parts of the compound (a) was not used in the <composition of the mordanting agent solution B> in the example 1.

Comparative Example 4

An ink-jet recording sheet of a comparative example (4) was produced in the same manner as in the example 1 except that 2.5 parts of a $CH3NHCH_2CH_2OH$ was used instead of 2.5 parts of the compound (a) was not used in the <composition of the mordanting agent solution B> in the example 1.

(Evaluation Test)

The following evaluation test was produced for each of the ink-jet recording sheets (1) to (36) of the invention and the comparative ink-jet recording sheets (1) to (4) obtained as mentioned above. The test results are shown in the following table 1.

<Ozone Resistance>

Solid images of cyan and magenta were printed on each ink-jet recording sheet using an ink-jet printer ("PM-900C", produced by Seiko Epson Corporation), and stored in an ozone density 2.5 ppm environment for 24 hours. The density of magenta and cyan was measured before and after the storage by a reflection density measurement unit ("Xrite 938" produced by Xrite Corp.), and the residual ratio of the magenta and cyan densities was calculated.

<Light Stability>

After forming solid images of cyan and magenta on each ink-jet recording sheet using an ink-jet printer ("PM-900C", produced by Seiko Epson Corporation), a cycle of lighting a lamp for 3.8 hours under a 25° C. temperature and 32% relative humidity environment condition using Xenon weather-ometer Ci65A (produced by ATLAS Corp.) through a film for cutting a ultraviolet ray in a 365 nm or less wavelength range, and leaving for 1 hour under a 20° C. temperature and 91% relative humidity environment condition with the lamp turned off was executed for 168 hours. The color image density was measured before and after the test by the reflection density measurement unit ("Xrite 938" produced by Xrite Corp.), and the residual ratio of each color image density was calculated.

TABLE 1

| | Ozone resistance | | Light stability | |
|---|---|---|---|---|
| | Magenta | Cyan | Magenta | Cyan |
| Example 1 | 85% | 90% | 90% | 98% |
| Example 2 | 83 | 88 | 89 | 97 |
| Example 3 | 81 | 86 | 86 | 98 |
| Example 4 | 83 | 87 | 88 | 98 |
| Example 5 | 82 | 85 | 86 | 98 |
| Example 6 | 79 | 83 | 85 | 97 |
| Example 7 | 80 | 84 | 89 | 98 |
| Example 8 | 77 | 82 | 87 | 98 |
| Example 9 | 80 | 86 | 88 | 97 |
| Example 10 | 81 | 86 | 88 | 97 |
| Example 11 | 81 | 85 | 88 | 97 |
| Example 12 | 77 | 85 | 85 | 98 |
| Example 13 | 83 | 87 | 88 | 97 |
| Example 14 | 79 | 84 | 86 | 98 |
| Example 15 | 72 | 83 | 85 | 96 |
| Example 16 | 72 | 82 | 85 | 97 |
| Example 17 | 83 | 85 | 87 | 98 |
| Example 18 | 75 | 80 | 84 | 97 |
| Example 19 | 76 | 80 | 85 | 97 |
| Example 20 | 72 | 81 | 85 | 97 |
| Example 21 | 71 | 80 | 84 | 96 |
| Example 22 | 72 | 80 | 85 | 97 |
| Example 23 | 78 | 85 | 86 | 98 |
| Example 24 | 81 | 86 | 85 | 98 |
| Example 25 | 76 | 84 | 85 | 97 |
| Example 26 | 72 | 82 | 83 | 97 |
| Example 27 | 89 | 89 | 93 | 99 |
| Example 28 | 88 | 90 | 92 | 98 |
| Example 29 | 88 | 88 | 91 | 98 |
| Example 30 | 88 | 89 | 92 | 98 |
| Example 31 | 88 | 90 | 92 | 99 |
| Example 32 | 85 | 89 | 89 | 97 |
| Example 33 | 84 | 88 | 92 | 99 |
| Example 34 | 85 | 89 | 90 | 98 |
| Example 35 | 85 | 87 | 89 | 97 |
| Example 36 | 87 | 90 | 88 | 98 |
| Comparative example 1 | 50 | 66 | 69 | 94 |
| Comparative example 2 | 53 | 67 | 97 | 94 |
| Comparative example 3 | 52 | 67 | 66 | 92 |
| Comparative example 4 | 55 | 69 | 68 | 94 |

From the results in the above-mentioned table 1, it was learned that the ink-jet recording sheets (examples 1 to 36) containing the compounds represented by the general formula (I) to (IV) of the invention are recording sheets with the excellent ozone resistance having a high density residual ratio of the formed image even after the long time storage under a high ozone density environment. Moreover, the density residual ratio of the formed image was high after the cycle test of xenon irradiation and leaving in a high humidity so that it was learned that they are recording sheets with the excellent light stability, in particular, in the light stability of the magenta color development.

Moreover, it was learned that the ink-jet recording sheets of the invention (examples 27 to 29) using a hindered amine based compound in a combination are ink-jet recording sheets with the further superior ozone resistance and light stability.

Furthermore, according to the ink-jet recording sheets (examples 33 to 35) using a metal compound in a combination, the image time passage blurring was further improved.

Moreover, the ink-jet recording sheets of the invention provide the excellent glossiness degree, ink absorbing speed, image part density and water resistance.

In contrast, the comparative ink-jet recording sheets not using the compounds represented by the general formulae (I) to (IV) have a low image density residual ratio after the test and insufficient ozone resistance and light stability.

According to the invention, an ink-jet recording sheet having a good ink receptivity, firmness without generation of cracking, capable of restraining generation of time passage blurring so as to form a high resolution image, with the excellent ozone resistance and light stability.

What is claimed is:

1. An ink-jet recording sheet comprising a color material accepting layer disposed on a substrate, the color material accepting layer containing a compound represented by the following general formula (I):

General formula (I)

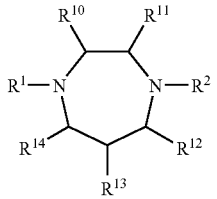

wherein, in the general formula (I), $R^1$ and $R^2$ each independently represent a hydrogen atom, an aliphatic group, an aromatic group, a heterocyclic group, —$COR^3$, —$COOR^4$, —$SO_2$—$R^5$, or —$N(R^6)R^7$; $R^3$ and $R^5$ each independently represent a hydrogen atom, an aliphatic group, an aromatic group, a heterocyclic group, or —$N(R^8)R^9$; $R^4$ represents a hydrogen atom, an aliphatic group, an aromatic group, or a heterocyclic group; $R^6$ through $R^9$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; $R^1$ and $R^2$ may link with each other so as to form a ring; $R^{10}$ through $R^{14}$ each independently represent a hydrogen atom, an aliphatic group, an aromatic group, a heterocyclic group, —$COR^{31}$, —$COOR^{32}$, or —$N(R^{33})R^{34}$; $R^{31}$ represents a hydrogen atom, an aliphatic group, an aromatic group, a heterocyclic group or —$N(R^8)R^9$; $R^{32}$ represents a hydrogen atom, an aliphatic group, an aromatic group, or a heterocyclic group, and $R^{33}$ and $R^{34}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group, wherein the color material accepting layer is formed by at least the step of homogeneously coating a color material accepting layer coating solution containing a compound represented by general formula (I).

2. The ink-jet recording sheet according to claim 1, wherein the color material accepting layer contains at least one compound represented by the general formula (I), fine particles and a water soluble resin.

3. The ink-jet recording sheet according to claim 2, wherein the fine particles comprise silica fine particles having an average primary particle size of 20 nm or less, alumina fine particles having an average primary particle size of 20 nm or less, or a quasi boehmite having an average pore radius of 2 to 15 nm.

4. The ink-jet recording sheet according to claim 2, wherein the water soluble resin comprises a polyvinyl alcohol or a derivative thereof.

5. The ink-jet recording sheet according to claim 2, wherein the color material accepting layer further contains a cross-linking agent capable of cross-linking the water soluble resin.

6. The ink-jet recording sheet according to claim 5, wherein the cross-linking agent comprises a boron compound.

7. The ink-jet recording sheet according to claim 1, wherein the color material accepting layer further contains a mordanting agent.

8. The ink-jet recording sheet according to claim 7, wherein the mordanting agent contains a poly amine having a mass average molecular weight of 300,000 or less or a derivative thereof as an organic mordanting agent, and contains at least one selected from the group consisting of an aluminum containing compound, a zirconium containing compound, a titanium containing compound, and a compound containing a metal of the third group in the periodic table of elements as an inorganic mordanting agent.

9. The ink-jet recording sheet according to claim 1, wherein the color material accepting layer further contains at least one kind of acidic compound.

10. The ink-jet recording sheet according to claim 1, wherein the color material accepting layer is obtained by coating a first coating solution containing at least fine particles and a water soluble resin on a surface of the substrate, and applying a second coating solution containing at least a mordanting agent (1) simultaneously with the coating of the first coating solution, (2) during the drying of a coating layer formed by coating of the first coating solution and before the coating layer displays a decreasing rate of drying, or (3) after drying of the first coating solution and formation of a coating film; and at least one compound represented by the general formula (I) is contained in at least one of the first coating solution and second coating solution.

11. The ink-jet recording sheet according to claim 1, wherein the color material accepting layer coating solution is coated by an extrusion die coater, an air doctor coater, a bread coater, a rod coater, a knife coater, a squeeze coater, a reverse roll coater, or a bar coater.

12. An ink-jet recording sheet comprising a color material accepting layer disposed on a substrate, the color material accepting layer containing a compound represented by the following general formula (II):

General formula (II)

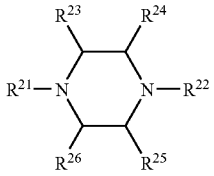

wherein, in the general formula (II), $R^{21}$ and $R^{22}$ each independently represent a hydrogen atom, an aliphatic group, an aromatic group, a heterocyclic group, —$COR^{53}$, —$COOR^{54}$, —$SO_2$—$R^{55}$, or —$N(R^{56})R^{57}$; $R^{53}$ and $R^{55}$ each independently represent a hydrogen atom, an aliphatic group, an aromatic group, a heterocyclic group, or —$N(R^{58})R^{59}$; $R^{54}$ represents a hydrogen atom, an aliphatic group, an aromatic group, or a heterocyclic group; $R^{56}$ through $R^{59}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group; $R^{21}$ and $R^{22}$ may link with each other so as to form a ring; $R^{23}$ represents an aliphatic group, an aromatic group, a heterocyclic group, —$COR^{71}$, —$COOR^{72}$, or —$N(R^{73})R^{74}$; $R^{24}$ through $R^{26}$ each independently represent a hydrogen atom, an aliphatic group, an aromatic group, a heterocyclic group, —$COR^{71}$, —$COOR^{72}$, or —$N(R^{73})R^{74}$; $R^{71}$ represents a hydrogen atom, an aliphatic group, an aromatic group, a heterocyclic group or —$N(R^{58})R^{59}$; $R^{72}$ represents a hydrogen atom, an aliphatic group, an aromatic group, and a heterocyclic group; and $R^{73}$ and $R^{74}$ each independently represent a hydrogen atom, an aliphatic group, an aromatic group, an acyl group, an alkoxy carbonyl group, an aryloxy carbonyl group, a carbamoyl group, an alkyl sulfonyl group, an aryl sulfonyl group, or a sulfamoyl group, wherein the color material accepting layer is formed by at least the step of homogeneously coating a color material accepting layer coating solution containing a compound represented by general formula (II).

13. The ink-jet recording sheet according to claim 12, wherein the color material accepting layer contains at least one compound represented by the general formula (II), fine particles and a water soluble resin.

14. The ink-jet recording sheet according to claim 13, wherein the fine particles comprise silica fine particles having an average primary particle size of 20 nm or less, alumina fine particles having an average primary particle size of 20 nm or less, or a quasi boehmite having an average pore radius of 2 to 15 nm.

15. The ink-jet recording sheet according to claim 13, wherein the water soluble resin comprises a polyvinyl alcohol or a derivative thereof.

16. The ink-jet recording sheet according to claim 13, wherein the color material accepting layer further contains a cross-linking agent capable of cross-linking the water soluble resin.

17. The ink-jet recording sheet according to claim 12, wherein the color material accepting layer further contains a mordanting agent.

18. The ink-jet recording sheet according to claim 17, wherein the mordanting agent contains a poly amine having a mass average molecular weight of 300,000 or less or a derivative thereof as an organic mordanting agent, and contains at least one selected from the group consisting of an aluminum containing compound, a zirconium containing compound, a titanium containing compound, and a compound containing a metal of the third group in the periodic table of elements as an inorganic mordanting agent.

19. The ink-jet recording sheet according to claim 12, wherein the color material accepting layer further contains at least one kind of acidic compound.

20. The ink-jet recording sheet according to claim 12, wherein the color material accepting layer is obtained by coating a first coating solution containing at least fine particles and a water soluble resin on a surface of the substrate, and applying a second coating solution containing at least a mordanting agent (1) simultaneously with coating of the first coating solution, (2) during the drying of a coating layer formed by coating the first coating solution and before the coating layer displays a decreasing rate of drying, or (3) after drying of the first coating solution and formation of a coating film; and at least one compound represented by the general formula (II) is contained in at least one of the first coating solution and second coating solution.

21. The ink-jet recording sheet according to claim 12, wherein the color material accepting layer coating solution is coated by an extrusion die coater, an air doctor coater, a bread coater, a rod coater, a knife coater, a squeeze coater, a reverse roll coater, or a bar coater.

* * * * *